US008800856B2

(12) United States Patent
Haramiishi et al.

(10) Patent No.: US 8,800,856 B2
(45) Date of Patent: Aug. 12, 2014

(54) BOX BODY

(75) Inventors: Kiichi Haramiishi, Gunma (JP); Hiroshi Sato, Gunma (JP)

(73) Assignee: MAX Co., Ltd., Tokyo (JP)

( * ) Notice: Subject to any disclaimer, the term of this patent is extended or adjusted under 35 U.S.C. 154(b) by 128 days.

(21) Appl. No.: 12/680,173

(22) PCT Filed: Sep. 26, 2008

(86) PCT No.: PCT/JP2008/067503
§ 371 (c)(1),
(2), (4) Date: May 19, 2010

(87) PCT Pub. No.: WO2009/041624
PCT Pub. Date: Apr. 2, 2009

(65) Prior Publication Data

US 2011/0155754 A1 Jun. 30, 2011

(30) Foreign Application Priority Data

Sep. 28, 2007 (JP) ..... 2007-255989

(51) Int. Cl.
*B65D 51/04* (2006.01)

(52) U.S. Cl.
USPC ..... 229/240; 220/810

(58) Field of Classification Search
USPC ..... 229/157, 156, 125, 158, 153, 241, 243, 229/244; 221/65
See application file for complete search history.

(56) References Cited

U.S. PATENT DOCUMENTS 4,042,110 A * 8/1977 Guernsey ..... 206/459.1
4,484,683 A * 11/1984 Werner, Jr. ..... 229/101.2

(Continued)

FOREIGN PATENT DOCUMENTS

GB 2198708 A 6/1988
GB 2217264 A 10/1989

(Continued)

OTHER PUBLICATIONS

David Grondin, Supplementary European Search Report for EP 08834357, Nov. 11, 2011.

(Continued)

*Primary Examiner* — Gary Elkins
*Assistant Examiner* — Christopher Demeree
(74) *Attorney, Agent, or Firm* — Chernoff, Vilhauer, McClung & Stenzel, LLP

(57) ABSTRACT

A container that is capable of loading articles onto a cassette for containing articles and the like with high reproducibility and is suitably applicable to a paper-made refill, is provided with, as shown in FIG. 1, if two constituting surfaces of container-constituting surfaces, which stand facing each other across an opening (6) with a predetermined size in one of the container-constituting surfaces, are supposed as first and second container-constituting portions (1 and 2), at least a lid-constituting portion (11) that has a width extending beyond the opening (6) and makes a mountain fold on the container-constituting portion (1), and a lid-closing portion (12) that makes a mountain fold on the lid-constituting portion (11) to engage the container-constituting portion (2). The container is formed so that when opening the opening (6), the lid-closing portion (12) disengages the container-constituting portion (2) and the lid-constituting portion (11) is folded back to a position so that it becomes the same wall surface as that of the container-constituting portion (1). When binding members (43) are taken outside while directing a side of the opening (6) downward, a side surface of each of the articles (30) comes into contact with a continuous wall surface formed of a wall surface constituting the container-constituting portion (1) and a wall surface constituting the lid-constituting portion (11) with it being along the continuous wall surface.

6 Claims, 25 Drawing Sheets

(56) References Cited

U.S. PATENT DOCUMENTS

| | | | | |
|---|---|---|---|---|
| 5,474,230 | A * | 12/1995 | Yotukura | 229/117.04 |
| 7,607,568 | B2 * | 10/2009 | Hatakeyama et al. | 229/185 |
| 8,061,584 | B2 * | 11/2011 | Takemoto et al. | 229/117 |

FOREIGN PATENT DOCUMENTS

| | | | |
|---|---|---|---|
| JP | S59-109621 | U | 7/1984 |
| JP | 7-329956 | A | 12/1984 |
| JP | 07-329956 | | 12/1995 |
| JP | 7329957 | A | 12/1995 |
| JP | 3047057 | U | 1/1998 |
| JP | 2004-99104 | A | 4/2004 |
| JP | 2004-243586 | A | 9/2004 |
| JP | 2004243586 | A | 9/2004 |
| TW | M252688 | | 12/2004 |

OTHER PUBLICATIONS

Japanese Patent Office, International Search Report for PCT/JP2008/067503, Nov. 4, 2008.

Notification of Reasons for Refusal for Japanese Patent Application No. 2007-255989 mailed Dec. 20, 2011, 4 pages.

Taiwan Intellectual Property Office, Prior Notification of Rejection in application No. 097136863, Oct. 21, 2013, 9 pages including translation.

* cited by examiner

BOX BODY

TECHNICAL FIELD

The present invention relates to a container, which is preferably applied to a carton containing a lot of small sized articles, to be handled, such as PET bottles, cans, cigarettes, pencils, and filled parts and a package box for various kinds of electric equipment or the like, particularly, applied to a paper-made refill or the like for carrying and filling consumables in a binding system that is provided with a cartridge into which a plurality of the consumables each having a long shape are loaded in a stacked manner.

BACKGROUND ART

Conventionally, a plurality of small sized articles, to be handled, such as PET bottles, cans, cigarettes, pencils, and filled parts have been often distributed with a desired carton containing them or various kinds of electric equipment or the like have been often distributed with a package box using corrugated cardboard containing them. Such a carton or a package box is made by performing the taking of measurements on carton material or box material with a predetermined size, creating a development of the container, cutting notches into predetermined portions of the developed container and erecting the container by making mountain or valley fold on the carton or box material.

In accordance with such a container, a packing case for supplement of goods and a method of supplementing the goods for a vending machine using the same have been disclosed in Japanese Patent Application Publication No. Hei05-04640. According to this packing case, the goods are contained in the container so that they are aligned in a longitudinal direction thereof. In the container, the goods are bound by a band for fixing the goods. The band is fixed into the container at forward and rearward ends thereof. The container is set onto the vending machine with a forward end thereof being positioned at a downward direction. It is constituted that after setting, a perforated portion is separated so that the forward end is opened and then, the band for fixing the goods is disengaged. By taking such a container configuration, it is capable of filling the goods into a desired position in the vending machine in the moment the band for fixing the goods is disengaged.

Further, a package box has been disclosed in Japanese Patent Application Publication No. 2001-02057. This package box has an outer container with a predetermined size and a triangular opening in an outer container configuration surface. On the other hand, an inner container is provided within the outer container. The inner container uses corrugated cardboard vertically. A lid-constituting portion is provided so as to extend from side surfaces of the outer container to an upper surface thereof continuously and is closed by a string on a predetermined position on the upper surface of the outer container. In this package box, it is configured that a stripe pattern of the corrugated cardboard of the inner container is exposed from the triangular opening. By configuring such a container, it is possible to present a package box that has strength vertically and is rich in a sense of high quality.

Further, a package with a dispenser has been disclosed in Japanese Patent Application Publication No. 2005-53555. In accordance with this package, a container having the dispenser at its forward end portion is provided. In the dispenser, a separation part is defined by cutting container-constituting portion that is constituted of side walls, an upper surface and a bottom surface of the forward end portion of the package into one with a predetermined size. An opening is obtained by folding a part by which a side of this separation part is common in the container-constituting portion and pulling out the separation part to a side of the container-constituting portion. It is constituted that when such an opened package is held so that its posture is directed to a vertical direction, the opening is positioned at a low position. The opening has such a size that allows a predetermined article contained in the package to be removed therefrom.

By taking such a container configuration, it is capable of easily removing the articles one by one from the package without any complicated works, thereby enabling workability to be improved.

An opening assist for a dispensing carton has been also disclosed in Japanese Patent Application Publication No. 2005-53584. In accordance with this dispensing carton, a container having the dispenser at its forward end portion is provided. In the dispenser, a displaceable portion is defined by cutting carton-constituting portion that is constituted of side walls, an upper surface and a bottom surface of the forward end portion of the container-constituting portion into one with a predetermined size. An opening is obtained by folding a part by which a side of this displaceable portion is common in the carton-constituting portion and tearing up the displaceable portion to this side. It is constituted that when such an opened package is held so that its posture is directed to a horizontal direction, the opening is positioned at an upper position. It is constituted that the opening has such a size that allows a predetermined article contained in the carton to be removed therefrom. By taking such a configuration, it is capable of dispensing the article from the carton without tearing up the carton main body.

According to the conventional containers each having the opening, however, there are problems as follows.

(i) As disclosed in Japanese Patent Application Publication No. Hei05-04640, Japanese Patent Application Publication No. 2001-02057, Japanese Patent Application Publication No. 2005-53555 and Japanese Patent Application Publication No. 2005-53584, the dispenser is formed by cutting the container-constituting portion that is constituted of side walls, an upper surface and a bottom surface of the forward end portion of the container-constituting surfaces into one with a predetermined size. Accordingly, if the container is installed into a vending machine, a binding machine or an automatic machine such as various kinds of power tools and the articles contained therein is provided (supplied) but a loading space is blocked in three directions when it has a dispenser configuration like ones disclosed in Japanese Patent Application Publication No. Hei05-04640, Japanese Patent Application Publication No. 2001-02057, Japanese Patent Application Publication No. 2005-53555 and Japanese Patent Application Publication No. 2005-53584, there is such a problem that any workability is deteriorated because an operator's hand does not reach the right and left side surfaces and a rear surface of the loading space.

(ii) Particularly, if a plurality of small articles each having a complicated shape are loaded onto the automatic machine or the like when the container with the dispenser disclosed in any of Japanese Patent Application Publication No. Hei05-04640, Japanese Patent Application Publication No. 2001-02057, Japanese Patent Application Publication No. 2005-53555 and Japanese Patent Application Publication No. 2005-53584 is applied from a point of view such that conveyance (delivery) of the articles and loading operation are compatible, there is such any possibility that loading operation thereof becomes difficult or complicated.

(iii) If the consumables are stacked in a container calling, for example, the refill and they are loaded from the refill into a cartridge of the binding system when the consumables are loaded from inside of the refill into the cartridge by free fall thereof, it is confirmed that any consumables may be inclined on the way for falling so that they are caught because it is impossible to control a posture of the falling consumable. Accordingly, a case may occur where they cannot be properly staked in the cartridge so that any poor separation of the consumables is generated.

(iv) By the way, it is conceivable how to tie up the stacked consumables with a string to keep the stacked condition thereof and cut the string after they are loaded onto the cartridge. When, however, adopting this method, there is such a problem that a predetermined shape thereof may be not kept if a shock or the like is applied to the stacked consumables from outside. Accordingly, under the existing circumstances, both problems of keeping a box shape and avoiding the free falling of the consumables cannot be solved.

DISCLOSURE OF THE INVENTION

This invention solves the above-mentioned problems and has an object of providing a container that is capable of loading any contents onto a cassette for containing articles and the like with good reproducibility from inside of the container and is suitably applied to a paper-made refill, which is applicable to a vending machine, various kinds of parts cassettes or the like.

In order to solve the above-mentioned problems, a container according to the present invention in which one of container-constituting surfaces forms an opening with a predetermined size, is provided with, if two constituting surfaces standing facing each other across the opening are supposed as first and second constituting surfaces, at least a first folding surface that makes a mountain fold on the first constituting surface, the first folding surface having a width extending beyond the opening, and a second folding surface that makes a mountain fold on the first folding surface to engage the second constituting surface. The container is characterized in that when opening the opening, the second folding surface disengages the second constituting surface and the first folding surface is folded back to a position so that it becomes the same wall surface as that of the first constituting surface.

In the container according to the present invention, when the contents are brought out with an opening side thereof facing downward, a side surface of any one of the contents contacts the continued wall surface formed by the wall surface constituted of the first constituting surface and the first folding surface along it. Accordingly, when loading the contents onto any desired cassette or the like for containing the articles, it is possible to control a posture of the contents each falling in parallel along the wall surface of the first folding surface, which is continuous with the wall surface of the first constituting surface. This enables the contents to be loaded onto the cartridge for containing the articles and the like with good reproducibility from inside of the container. Further, it is possible to apply the container suitably to a paper-made refill or the like, which is applicable to a vending machine, various kinds of parts cassettes or the like.

BRIEF DESCRIPTION OF THE DRAWINGS

FIG. 8 is a perspective view of the container 100 showing a configuration example thereof when loading it into the automatic machine 400 or the like.

BEST MODE FOR CARRYING OUT THE INVENTION

The following will describe embodiments of a container according to the present invention with reference to drawings.

Figure 1:
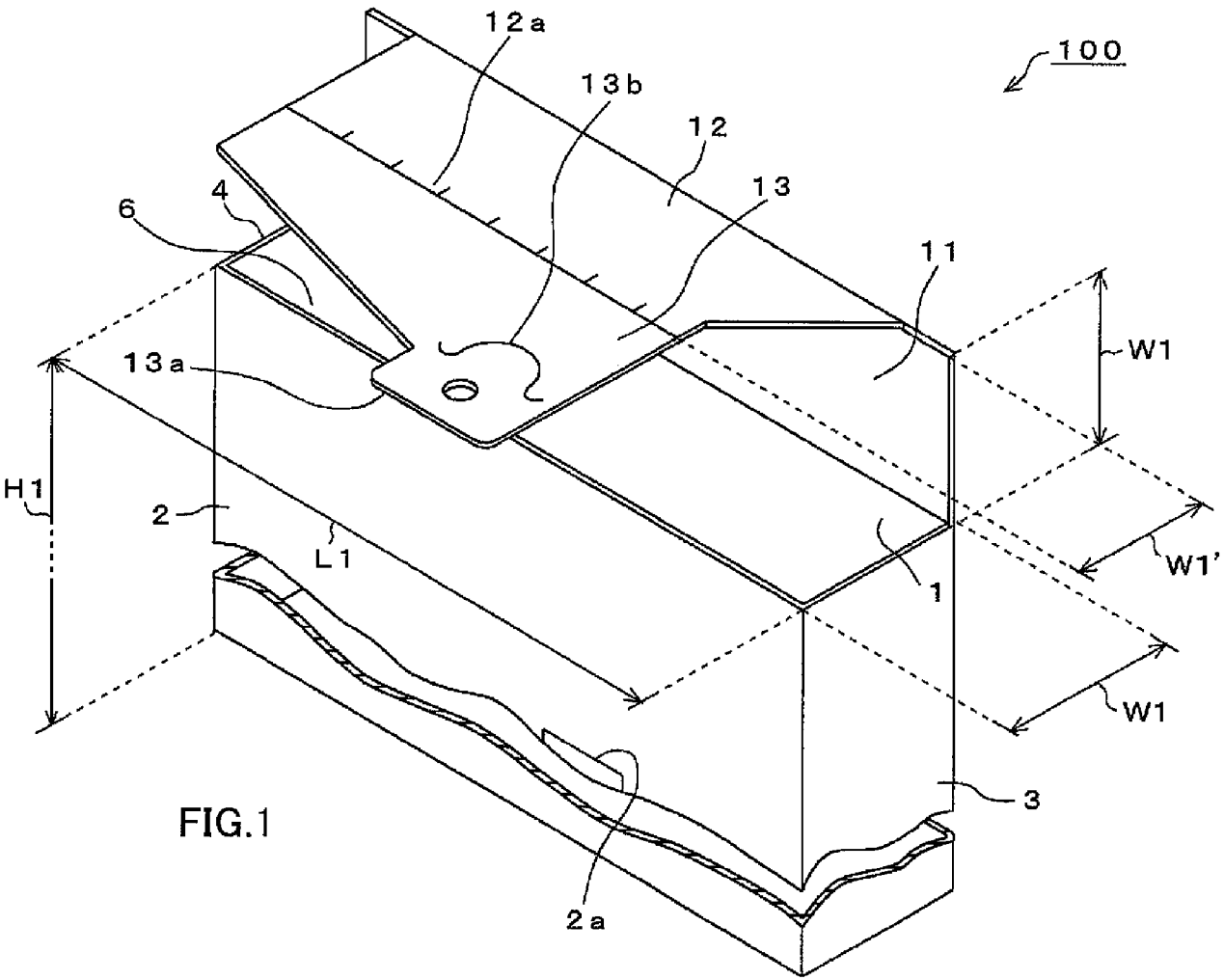
FIG. 1 is a conceptual diagram showing a configuration example of a container 100 as an embodiment according to the present invention.

The embodiment of the container 100 according to the invention, shown in FIG. 1, is applicable to a package box for a plurality of small sized articles, to be handled, such as PET bottles, cans, cigarettes, pencils, and filled parts and for various kinds of electric equipment or the like. Particularly, this container 100 is applicable to a paper-made refill or the like for carrying and loading consumables, for which any contents in which a plurality of consumables each having long shape are stacked are handled in a binding system. In the container 100, one of container-constituting surfaces forms an opening 6 with a predetermined size. In other words, one of the six surfaces constituting the container 100 is opened. The following will describe the container-constituting surface as a container-constituting portion (part).

A size of the entire container 100 is constituted of a height H1, a length L1 and a width W1. A size of the opening 6 is obtained by multiplying L1 by W1. In the container 100, if two container-constituting portions standing facing each other across the opening 6 are supposed as first container-constituting portion 1 and second container-constituting portion 2, a first lid-constituting portion 11 constituting a first folding surface is unfolded onto the container-constituting portion 1 as a side wall.

In these embodiments, the lid-constituting portion 11 extends continuously from a side prescribing the length L1 of the container-constituting portion 1 up to a length similar to the width W1 of the opening 6. The lid-constituting portion 11 has a width (length) extending beyond the opening 6 of L1 multiplied by W1. The lid-constituting portion 11 folds and makes a mountain fold on the container-constituting portion 1 on the basis of outside of the container.

A lid-closing portion 12 and a lid-closing portion 13 (separable portion), which constitute a second folding surface, are unfolded onto the lid-constituting portion 11. The lid-closing portion 12 and the lid-closing portion 13 make a mountain fold on the lid-constituting portion 11. The lid-closing portion 13 is formed so that it engages the container-constituting portion 2. In these embodiments, lid-closing portion 12 extends continuously from a side prescribing the length of the lid-constituting portion 11 up to a width (length) W1' that is almost similar to the width W1 of the opening 6. The lid-closing portion 12 has a trapezoid such that both sides are cut and has an area less than that of the rectangular of the lid-constituting portion 11. The lid-closing portion 12 makes a mountain fold on the lid-constituting portion 11.

The separable lid-closing portion 13 is unfolded onto the lid-closing portion 12. In these embodiments, the lid-closing portion 13 extends continuously from a side prescribing the width of the lid-closing portion 12 up to a predetermined length. The lid-closing portion 13 has a predetermined shape and a size and is connected to the lid-closing portion 12 through a configuration of cuts 12*a* on the same plane. The lid-closing portion 13 is shaped so as to become a flat trapezoid with a protrusion 13*a*. The protrusion 13*a* constitutes a grip.

In these embodiments, an engaged portion 2*a* is provided in the container-constituting portion 2 at its predetermined position and an engaging portion 13*b* is provided in the lid-closing portion 13 at its predetermined position. The engaged portion 2*a* is formed by, for example, cutting a groove forming a slit at a position of the container-constituting portion 2, which lies slightly toward a side of the container-constituting portion 3 away from middle thereof. The engaging portion 13*b* is formed by cutting a groove in semicircle at a lower position of the protrusion 13*a*. In these embodiments, when closing the opening 6, to the semicircular engaging portion 13*b* of the lid-closing portion 13 is inserted into (engages) the engaged portion 2*a* forming the slit of the container-constituting portion 2.

For example, when opening the opening 6, the engaging portion 13*b* of the lid-closing portion 13 first disengages the engaged portion 2*a* of the container-constituting portion 2. Next, the lid-closing portion 13 enters a state of disengaging the container-constituting portion 2. Further, the lid-constituting portion 11 is folded back to a position so that it becomes the same wall surface as that of the container-constituting portion 1. Thereafter, the lid-closing portion 13 is cut off.

Regarding other container-constituting portions, container-constituting portions 3, 4 are arranged between the container-constituting portions 1 and 2. The container-constituting portion 3 is walled so that it constitutes a side wall. The container-constituting portion 4 is walled so that it constitutes the other side wall. On a bottom side shown in FIG. 1, a container-constituting portion 5 is walled. Thus, the container 100 having a single lid structure is configured.

Configuring such a container 100 allows contents of the container 100 to be covered by the container-constituting portions 1, 2, the lid-constituting portion 11 and other container-constituting portions 3, 4 after the container has contained the contents and the opening 6 has closed. This also enables a predetermined shape of each of the contents to be kept. Further, if the contents are dropped and contained into a desired cassette or the like for containing articles while directing the opening 6 downward, the lid-closing portion 12, a posture of which is kept to a position almost perpendicular to the lid-constituting portion 11, can support the contents. The lid-closing portion 13 may be cut off under a condition such that weights of the contents are applied to the lid-closing portion 12.

Figure 2:
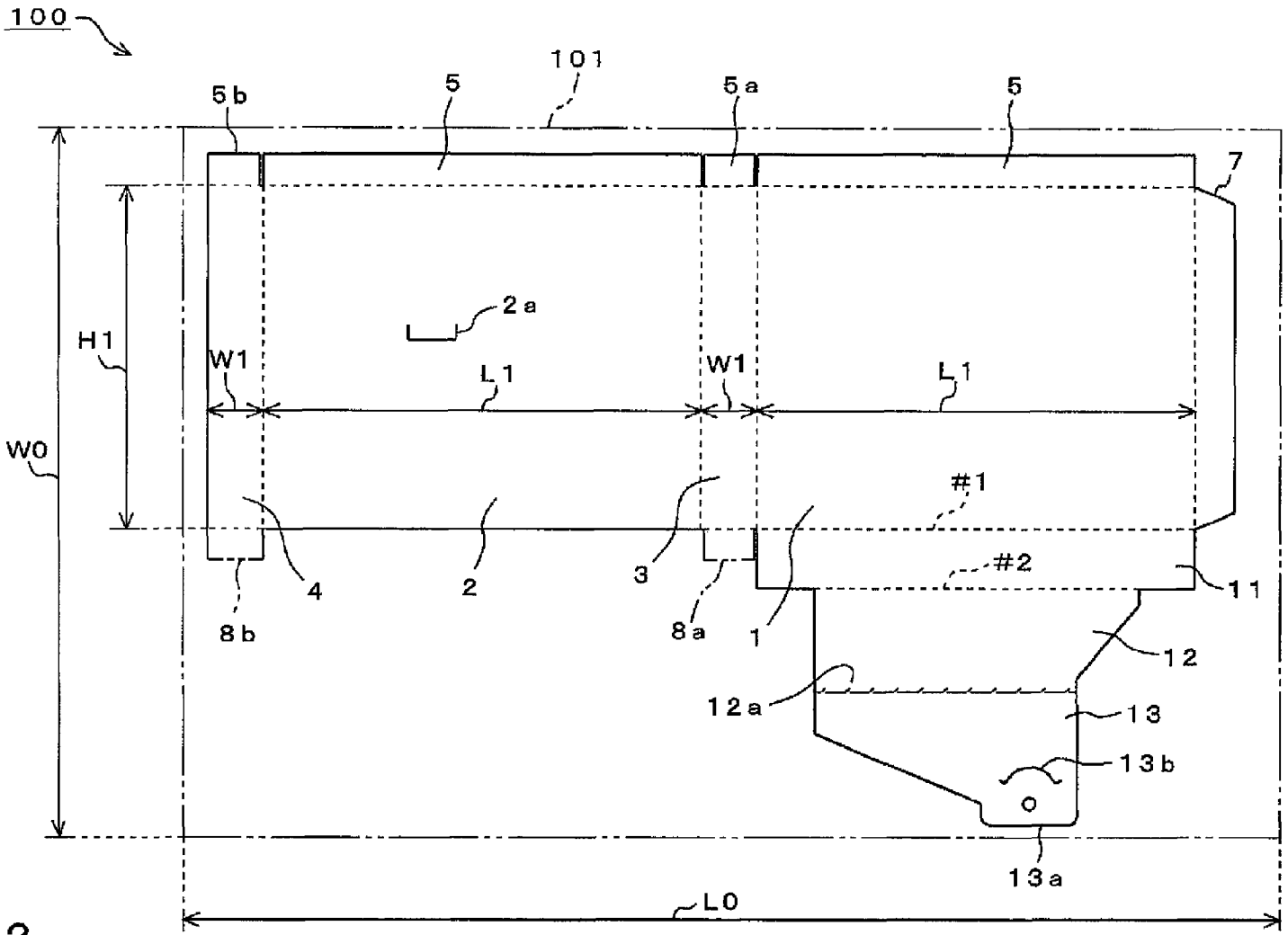
FIG. 2 is a diagram showing an example of measurements in container material 101.

The following will describe a method of manufacturing the container 100 with reference to FIG. 2. When manufacturing the container 100 as shown in FIG. 1, for example, a container material 101 having a size like an exploded example of the container 100 shown in FIG. 2 is prepared. As the container material 101, for example, coated cardboard with paper quality of 350 g/m$^2$ is used. A development may be drawn so that a coated surface thereof forms an inside of the container 100. This is because the parts contained in the container 100 are easy to slide inside the container and are easy to be loaded into an automatic machine or the like when loading the parts thereinto.

The coated cardboard has a size constituted of a vertical length W0 and a horizontal length L0. Though depending on a finished measurement of the container 100, the vertical one W0 may be almost (5 through 7)W1+H1 and the horizontal one L0 may be almost 2L1+2W1+a margin for connection or more. The container material 101 is not limited to the coated cardboard but corrugated cardboard, plastic panel with a predetermined thickness may be used therefor according to containing uses. If a container which can be used repeatedly again and again is formed, the container using the plastic panel can be increased in its used times more than that of a paper container.

According to a developed example of the container 100 shown in FIG. 2, the container-constituting portions 1 and 2 each having length L1 and height H1, the container-constituting portions 3 and 4 each having width W1 and height H1, and the margin 7 for connection of height H1 are drawn above almost a half of the container material 101. The container-constituting portions 1 and 2, the container-constituting parts 3 and 4 and the margin 7 for connection are continuously arranged so that they are aligned horizontally.

Further, the lid-constituting portion 11 of length L1 and width W1, the lid-closing portion 12, the trapezoidal lid-closing (separable) portion 13, and the protrusion 13*a* forming the grip are drawn below the container-constituting portion 1. These lid-constituting portion 11, lid-closing portion 12, lid-closing (separable) portion 13 and the protrusion 13*a* are arranged at positions that are continuous with the container-constituting portion 1. The engaged portion 2*a* is drawn in the container-constituting portion 2 and then is opened.

In these embodiments, a perforation is performed on a borderline of the lid-closing portions 12 and 13 so that the configuration of cuts 12*a* is formed. In the figure, #1 and #2 depict folding lines. The folding line #1 forms a borderline of the container-constituting portion 1 and the lid-constituting portion 11 and the folding line #2 forms a borderline of the lid-constituting portion 11 and the lid-closing portion 12.

Further, regarding a shape of a bottom of the container 100, for example, if opening it into two parts as portmenteau, a container-constituting portion 5 of length L next to the container-constituting portion 2, a container-constituting piece 5*a* of length W1 next to the container-constituting portion 3, a container-constituting portion 5 of length L next to the container-constituting portion 1, and a container-constituting piece 5*b* of length W1 next to the container-constituting portion 4 are drawn.

It is to be noted that, in the figure, a container-constituting piece 8*a* may be disposed on a position under the container-constituting portion 3 shown by alternate long and two short dashes line and a container-constituting piece 8*b* may be disposed on a position under the container-constituting portion 4 shown thereby. The container-constituting piece 8*a* makes a mountain fold on the container-constituting portion 3 next to the container-constituting portion 1. The container-constituting piece 8*b* makes a mountain fold on the container-constituting portion 4 next to the container-constituting portion 2. Disposition of the container-constituting pieces 8*a*, 8*b* enables the strength of the entire container 100 to be increased. Of course, the disposition of the container-constituting pieces 8*a*, 8*b* may be omitted.

Figure 7:
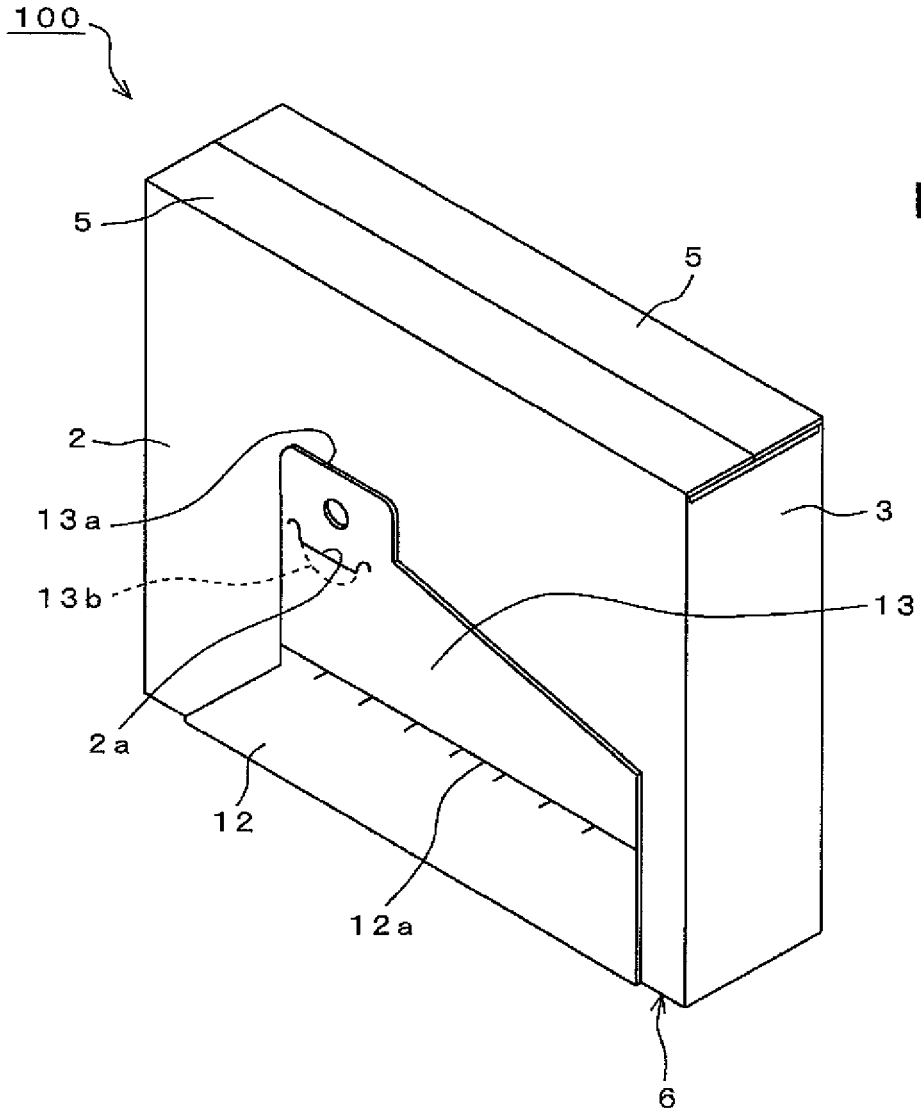
FIG. 7 is a perspective view of the container 100 showing an outline example thereof when completing closing the lid.

In the figure, broken lines other than the folding lines #1 and #2 show positions for folding and making mountain folds thereon. In these embodiments, when cutting the container material 100 along solid lines by using a cutter, scissors or the like, a developed shape of the container 100 is completed as shown in FIG. 1. Further, when erecting it by folding and making mountain folds along the above-mentioned broken lines, the container 100 as shown in FIG. 7 can be completed.

Embodiment 1

Figure 3:
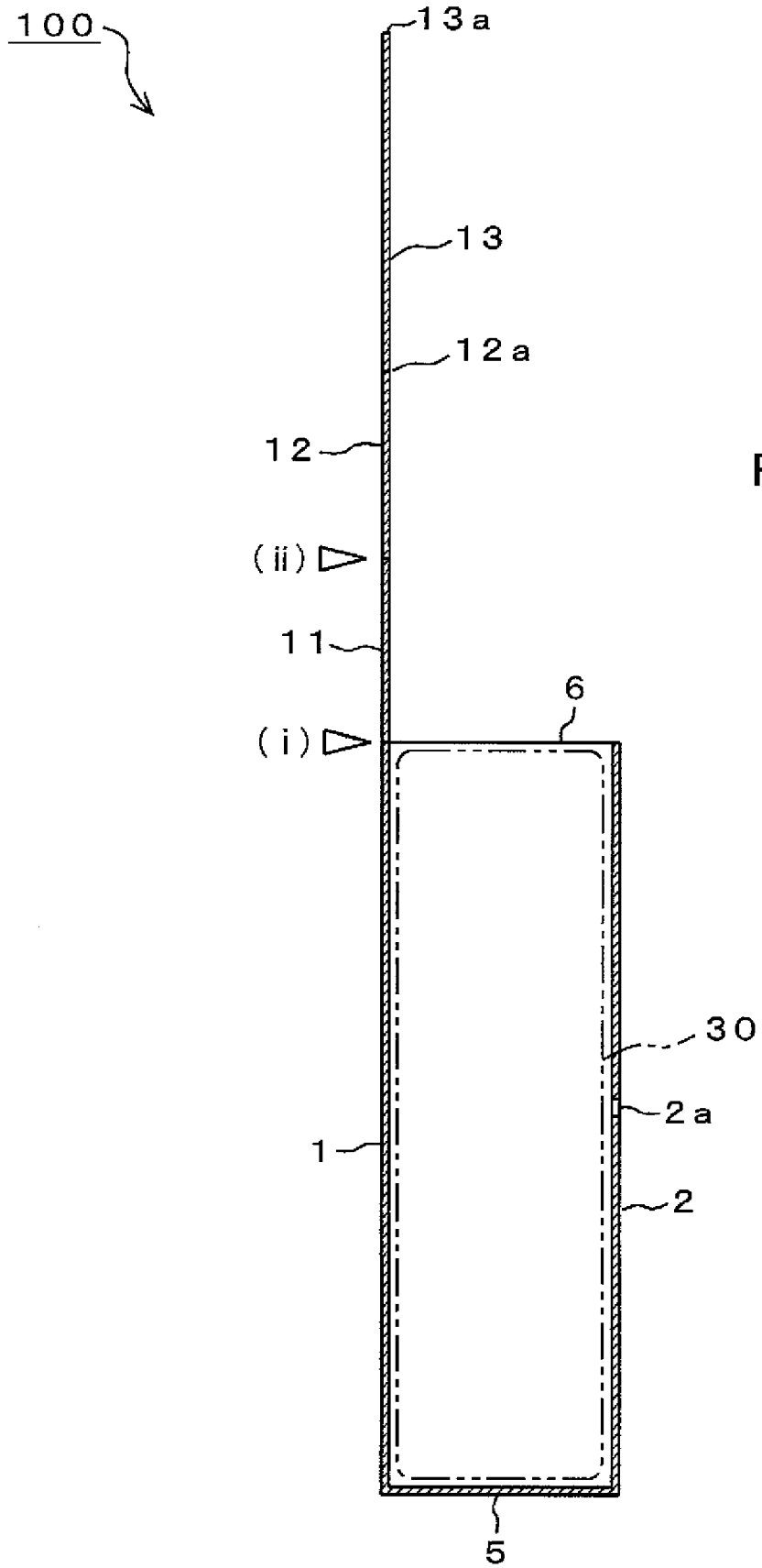
FIG. 3 is an erecting-process diagram showing a lid-closing example (part one thereof) of the container 100 according to a first embodiment.
Figure 4:
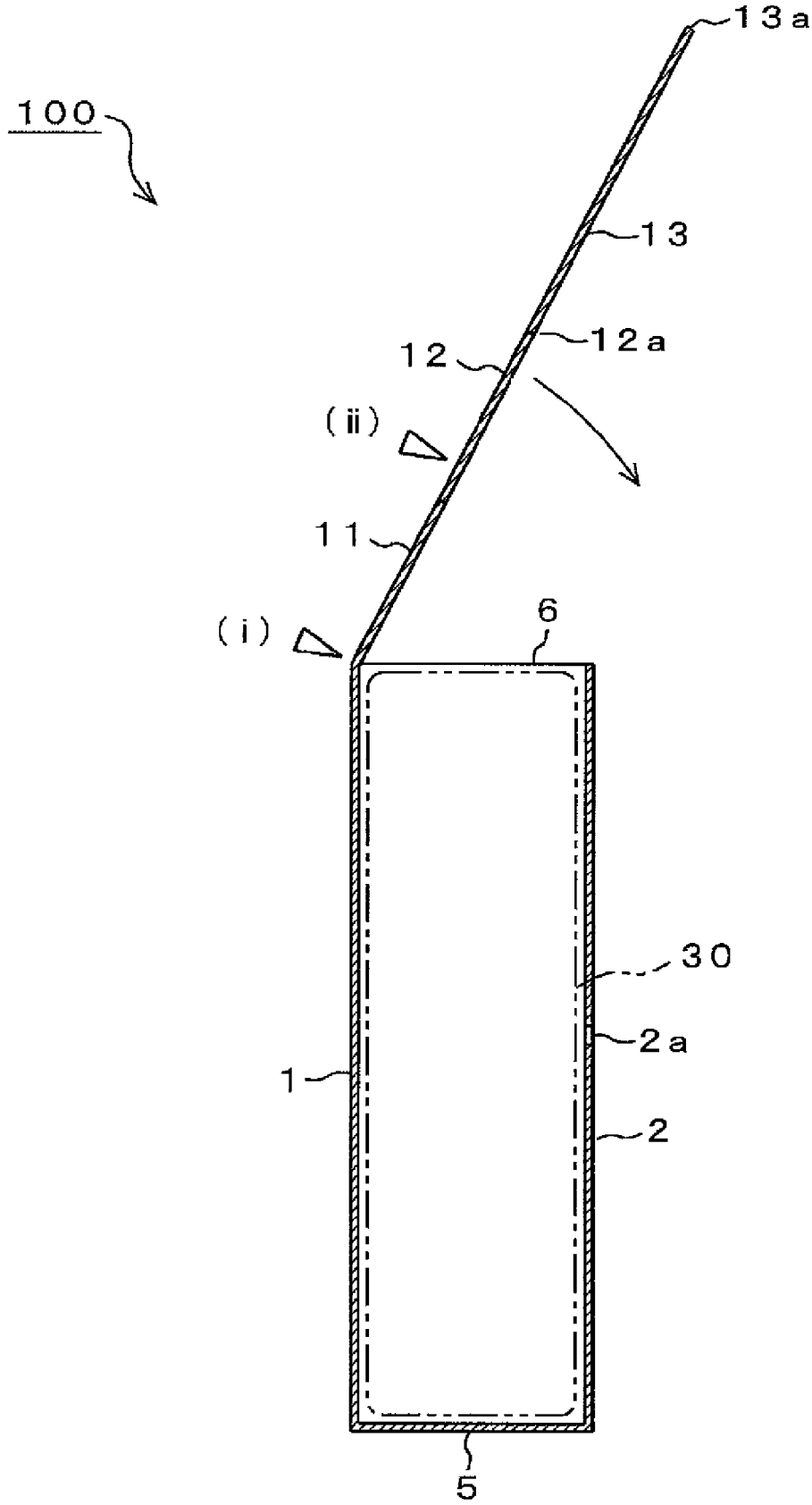
FIG. 4 is the erecting-process diagram showing the lid-closing example (part two thereof) of the container 100.
Figure 5:
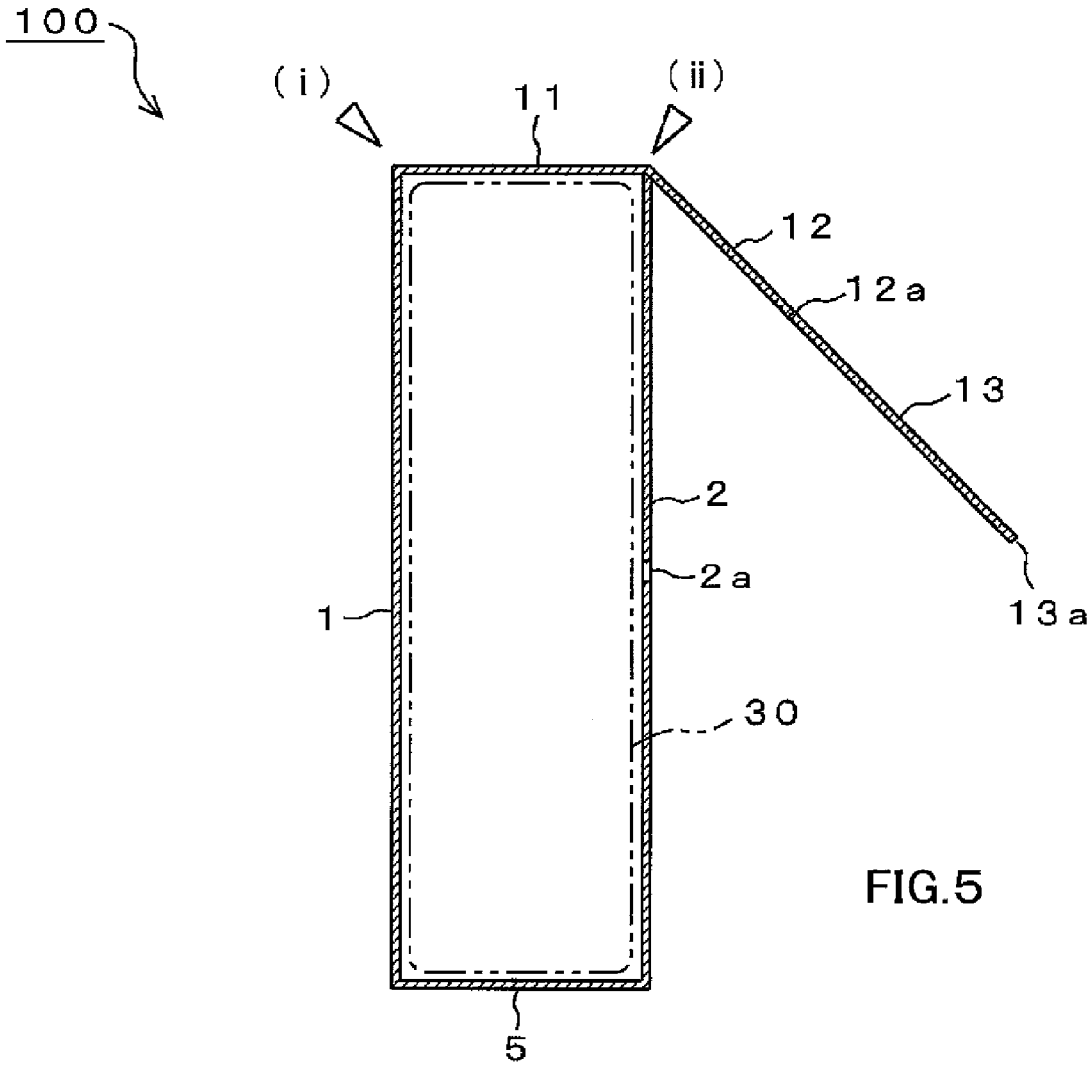
FIG. 5 is the erecting-process diagram showing the lid-closing example (part three thereof) of the container 100.

The following will describe a lid-closing example of the container 100 according to a first embodiment with reference to erecting-process diagrams of FIGS. 3, 4, 5, 6A and 6B. Triangle marks (i) and (ii) in white shown in FIGS. 3 through 5 are all folding positions (positions of the folding lines #1 and #2).

First, the container 100 shown in FIG. 3 is prepared. In order to obtain the container 100, each of the container-constituting portions 1 through 4 and the margin 7 for connection in the developed form shown in FIG. 2 folds and makes a mountain fold to form the container-constituting portions 1 through 4 as a box. The container-constituting portion 4 and the margin 7 for connection are connected with each other by an adhesive, a staple or the like. The container-constituting pieces 5*a*, 5*b* to build up a bottom surface are then folded inwardly in advance and the container-constituting portions 5 fold and make mountain folds onto the container-constituting pieces 5*a*, 5*b*. It is constituted that butt portions of the container-constituting portions 5 are stuck by a tape or the like.

Thus, as shown in FIG. 3, the container 100 is obtained such that the lid-constituting portions 11, 12, the lid-closing portion 13 and the protrusion 13*a* forming the grip extend upwards in succession from the container-constituting portion 1 and the opening 6 is defined.

In this embodiment, articles 30 are contained into the container 100 from the opening 6 shown in FIG. 3. The articles 30 are, for example, a plurality of small sized ones, to be handled, such as PET bottles, cans, cigarettes, pencils, and filled parts, various kinds of electric equipment or the like.

Next, as shown in FIG. 4, the opening 6 is closed. In this moment, the lid-constituting portion 11 folds and makes mountain folds on the folding positions (i). Further, as shown in FIG. 5, the lid-closing portion 12 folds and makes mountain folds on the folding positions (ii) so that the lid-closing portion 12 covers over the opening 6.

Figure 6A:
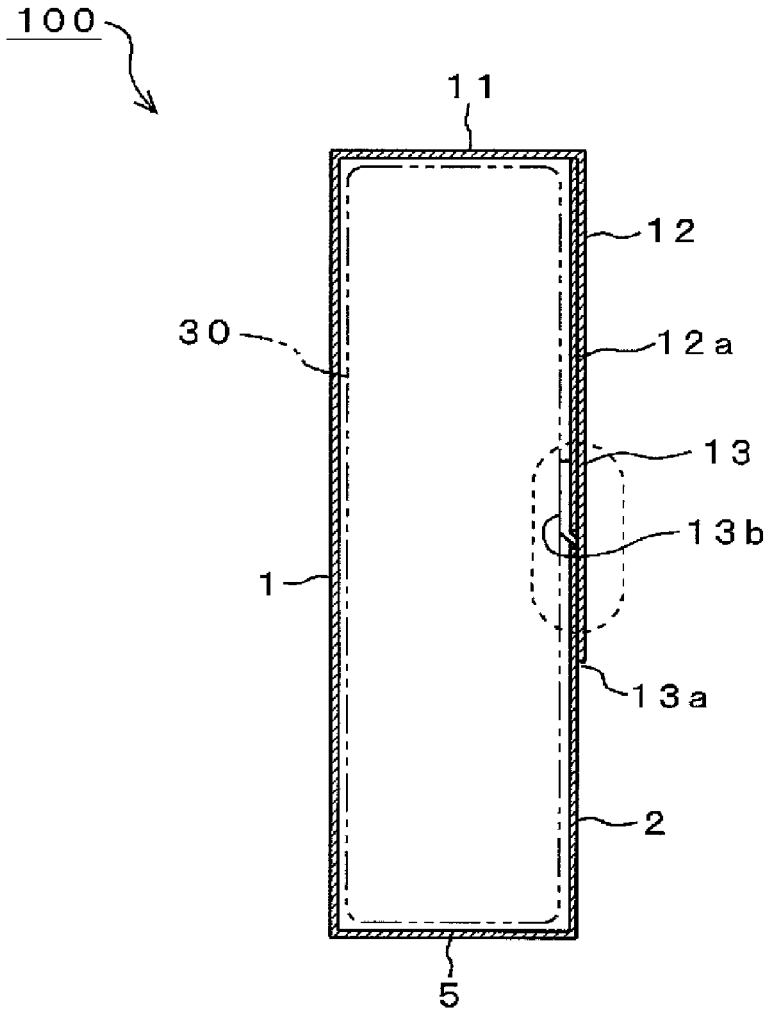
FIG. 6A is the erecting-process diagram showing the lid-closing example (part four thereof) of the container 100.
Figure 6B:
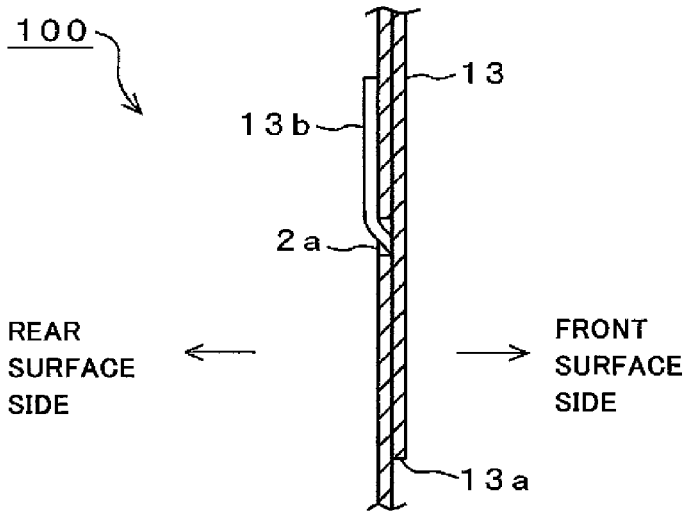
FIG. 6B is an enlarged diagram showing a lid-closing portion, which is illustrated in an ellipse by the dashed line, in the container 100 shown in FIG. 6A.

The lid-constituting portion 11 and the lid-closing portion 12 then wraps a corner of the opening 6 on the folding position (ii) shown in FIG. 5. Further, the lid-closing portions 12 and 13 cover over the container-constituting portion 2. As shown in FIG. 6A, the engaging portion 13*b* then engages the engaged portion 2*a*. In this embodiment, the semicircular engaging portion 13*b* is inserted into the engaged portion 2*a*, in the enlarged sectional view of FIG. 6B, from a front surface of the container-constituting portion 2 to a rear surface thereof. A forward end of the engaging portion 13*b* catches the engaged portion 2*a* so that the lid-closing portion 13 is locked. Of course, an engaging method is not limited thereto; a double-sided tape may stick the protrusion 13*a* forming the gripe and the container-constituting portion 2. Thus, the opening 6 in the container 100 can be firmly closed (see FIG. 7).

According to an outline example, shown in FIG. 7, of the container 100 when completing closing the lid, it is possible to fix the lid-closing portion 13 on the container-constituting portion 1 exactly. Even if the container-constituting portion 5 is directed upward and a single lid structure part is directed downward, it is also possible to maintain the closed state of the opening 6 steadfastly as shown in FIG. 7. Configuring such a container 100 allows the articles, which are easy to be separated, to be handled with ease by the container-constituting portions 1 through 5, the lid-constituting portion 11, and the lid-closing portions 12 and 13. It is capable of protecting the contents when carrying them or transporting them. When loading the articles, touching the contents directly with hand can be avoided so that it is possible to prevent the articles from being deformed.

When loading the container 100 onto an automatic machine, a power tool or the like, the protrusion 13*a* forming the grip, which extends to this side, is pulled while the container 100 is loaded onto the automatic machine, the power tool or the like. This enables the lid-constituting portion 11 and the lid-closing portions 12 and 13 to be easily opened.

Figure 8:
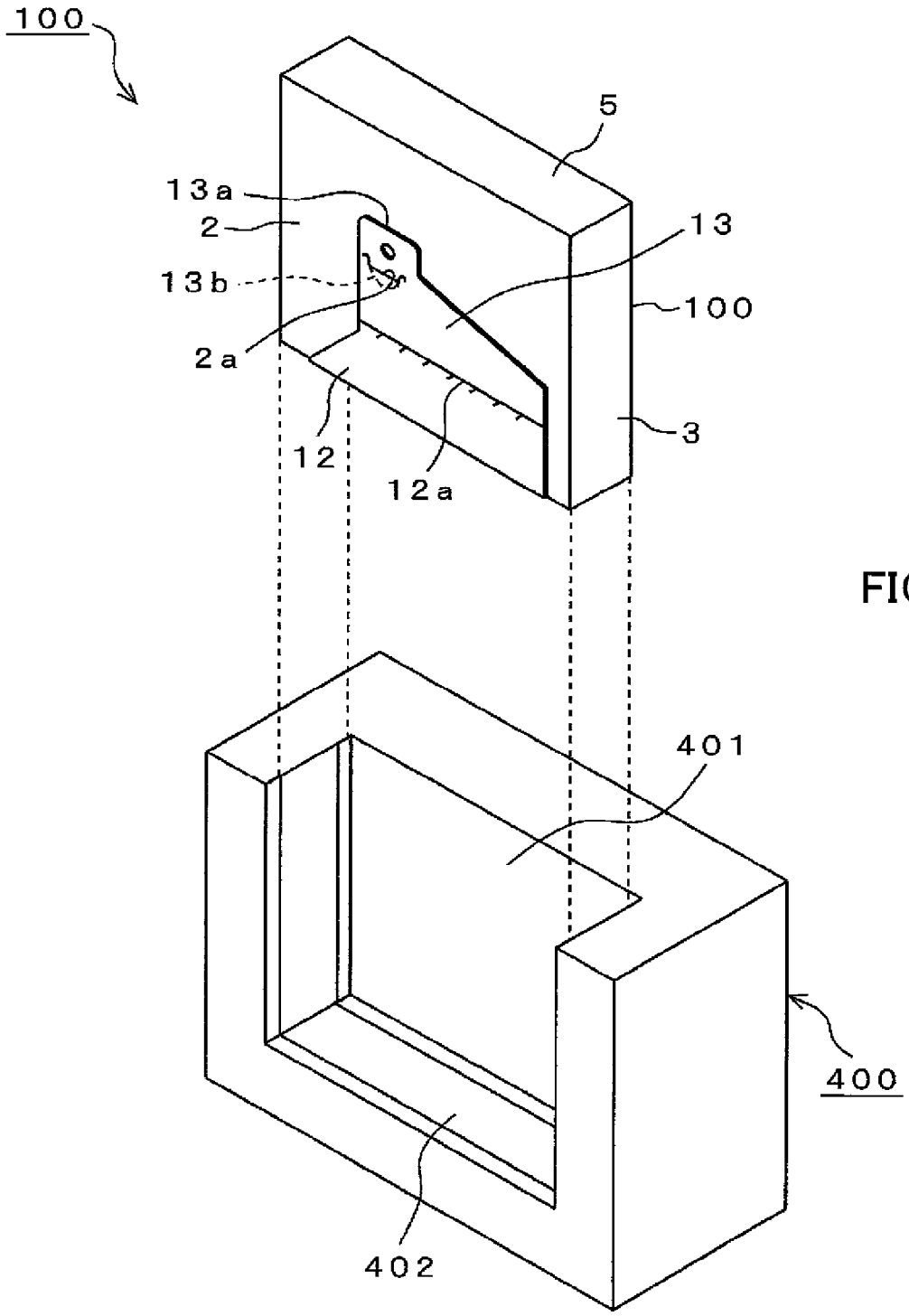
Figure 9:
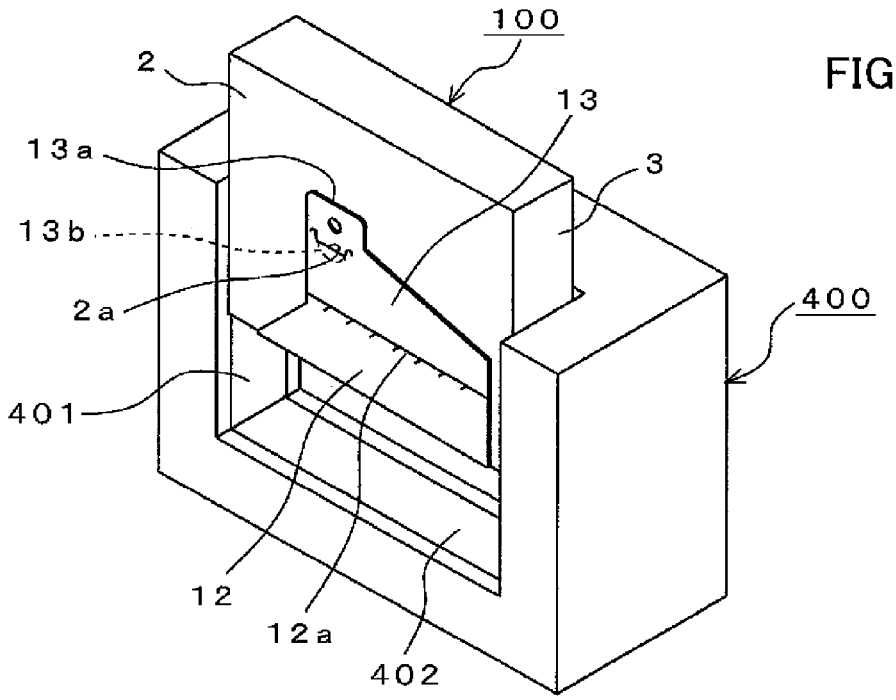
FIG. 9 is a perspective view showing a loaded example of the container 100.

Next, the following will describe a loaded example of the container 100 onto an automatic machine 400 or the like with reference to FIGS. 8 and 9. In this embodiment, the container 100 is loaded onto the automatic machine 400 or the like with a side of its lid-closing portion being directed downward.

The automatic machine 400 shown in FIG. 8 is a vending machine, a binding machine, various kinds of power tools or the like and has a loading space 401 for loading the container 100 as shown in FIG. 7. The loading space 401 is blocked in its three directions. Namely, there is a situation such that an operator's hand cannot enter into right and left side surfaces and a back surface of the loading space 401. A side of a bottom surface of the loading space 401 becomes parts-loading space 402, which has often such a structure that an operator's hand cannot enter into it depending on a type of automatic machine 400.

When the container 100 with a single lid structure according to the present invention is loaded onto the automatic machine 400 having such a loading space 401, the container 100 is laded so that it is directed from an upper part of the loading space 401 to a lower part thereof or from a front surface thereof to a back surface thereof.

According to the loaded example of the container 100 shown in FIG. 9, a mechanism of stopping the container 100 at a middle of the loading space 401 is provided. For example, a stopper mechanism, not shown, is provided at the right or left side surface or a back surface of the loading space 401. It is configured that when dropping the container 100 from the upper part of the loading space 401 to a lower part thereof along it, the stopper mechanism stops movement of the container 100. Such a mechanism enables to be realized a structure in which the operator's hand can enter into a lower part of the loading space 401 under the container 100 stopping at a middle thereof, thereby keeping any working space.

In this embodiment, it is configured that the lid-constituting portions 11 and the lid-closing portion 12 are opened by pulling the lid-closing portion 13 positioned at this side under a situation where the container 100 is loaded onto the above-mentioned loading space 401.

Next, the following will describe a lid-opening example of the container 100 with reference to FIGS. 10A and 10B, 11, 12, 13 and 14. In this embodiment, a case is illustrated where the container 100 having the single lid structure according to the invention is loaded onto the automatic machine 400 shown in FIG. 8 and the articles 30 are loaded thereto, and the configuration of cuts 12*a* is provided at a predetermined position of the lid-closing portion 12, which is away from the engaging portion 13*b* of the lid-closing portion 13 by a predetermined distance. A posture of the lid-closing portion 12 is kept at a position that is almost perpendicular to the lid-constituting portion 11. Then, the following will describe a case where the side of the engaging portion 13*b* of the lid-closing portion 13 while its posture is maintained is cut off from the configuration of cuts 12*a*. It is to be noted that in FIGS. 10A and 10B, 11, 12, 13 and 14, as for the automatic machine 400, only the parts-loading space 402 is shown by alternate long and two short dashes line and a case where the articles 30 are loaded onto the parts-loading space 402 is illustrated.

Figure 10A:
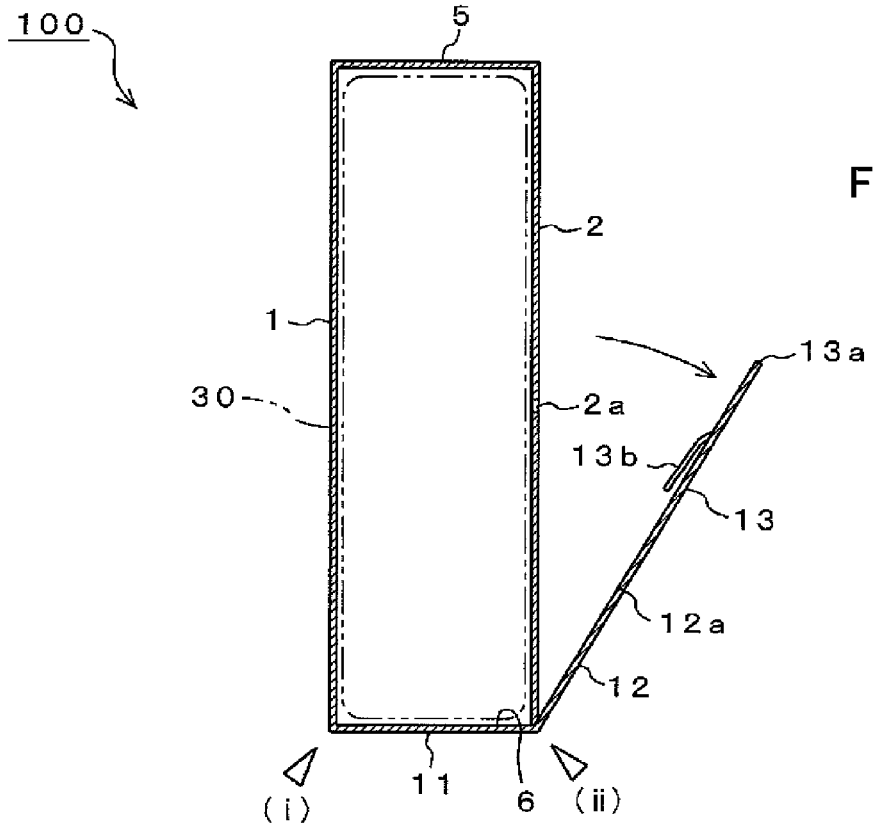
FIG. 10A is a cross sectional view of the container 100 showing a lid-opening example thereof (part one thereof).
Figure 10B:
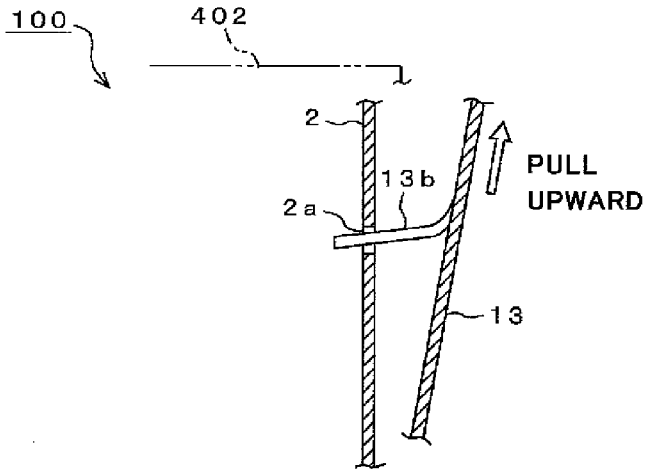
FIG. 10B is an enlarged view of a lid-opening portion of the container 100 shown in FIG. 10A.

First, the container 100 is loaded onto the automatic machine 400 as shown in FIG. 9. Next, by taking the lid-closing portion 13 out of the container-constituting portion 2 as shown in FIG. 10A, the opening 6 is opened. In this moment, a user may pull the lid-closing portion 13 toward this side while the protrusion 13*a* (grip) thereof is held and pulled tight upward. This allows the engaging portion 13*b* to disengage the engaged portion 2*a*. According to FIG. 10B where this portion is enlarged, the engaging portion 13*b* is pulled out of the engaged portion (slit portion) 2*a* so that the engaged portion 2*a* and the engaging portion 13*b* are separated from each other.

Figure 11:
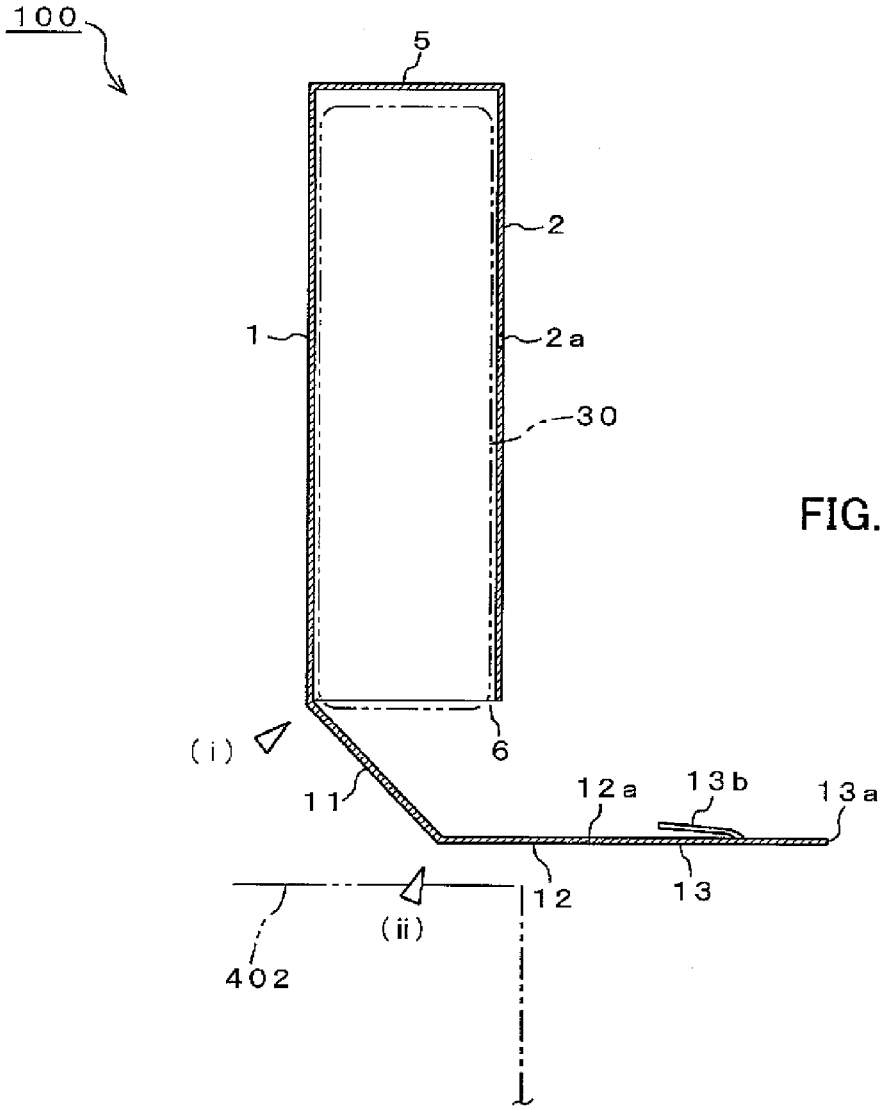
FIG. 11 is a cross sectional view of the container 100 showing the lid-opening example thereof (part two thereof).

Next, the container 100 is operated so that the lid-constituting portion 11 is bent back in a direction of making valley folds based on the folding position (i) shown in FIG. 11. In this moment, a user moves the lid-constituting portion 11 backward while he is pulling the lid-closing portion 13 toward this side, thereby opening the opening 6. According to this opening operation, the articles 30 contained in the container 100 are barely held by a part of the lid-constituting portion 11 so as to become a situation just before the articles 30 drop.

Figure 12:
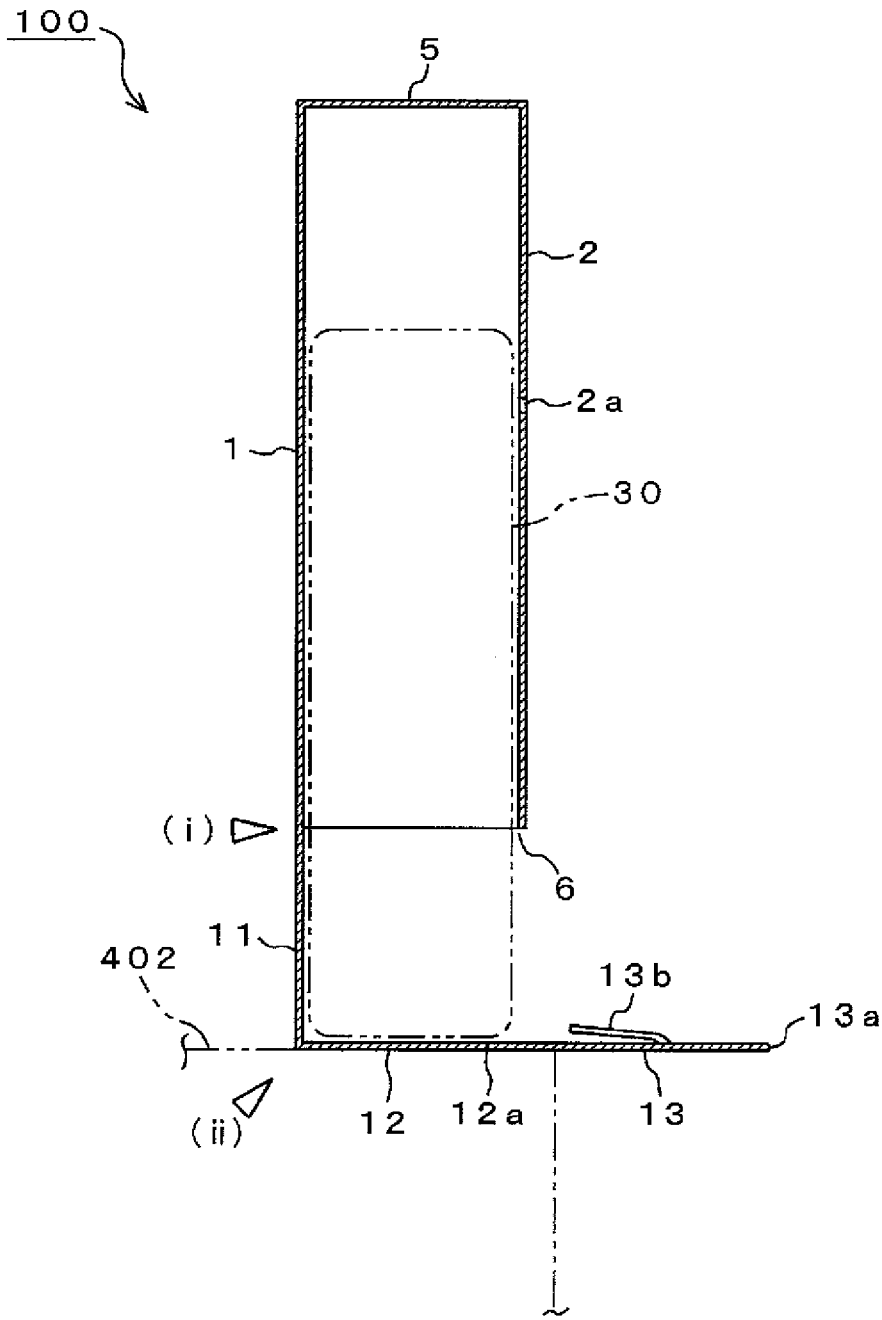
FIG. 12 is a cross sectional view of the container 100 showing the lid-opening example thereof (part three thereof).

Then, the bending-back operation in a direction of making valley folds based on the folding position (i) as shown in FIG. 12 goes on. By this operation, the lid-constituting portion 11 and the container-constituting portion 1 form the same wall surface. In this moment, the user moves the lid-constituting portion 11 backward while he is pulling the lid-closing portion 13 toward this side, thereby opening the opening 6. By this continued opening-operation, the articles 30 contained in the container 100 drop (fall in parallel) along a wall surface of the lid-constituting portion 11. In this moment, along a continuous wall surface constituted of a wall surface formed by the container-constituting portion 1 and a wall surface formed by the lid-constituting portion 11, a side surface of each of the articles contacts it. By such a falling-in-parallel, the articles 30 become a state so as to hold them by the lid-closing portion 12 on the parts-loading space 402.

Figure 13:
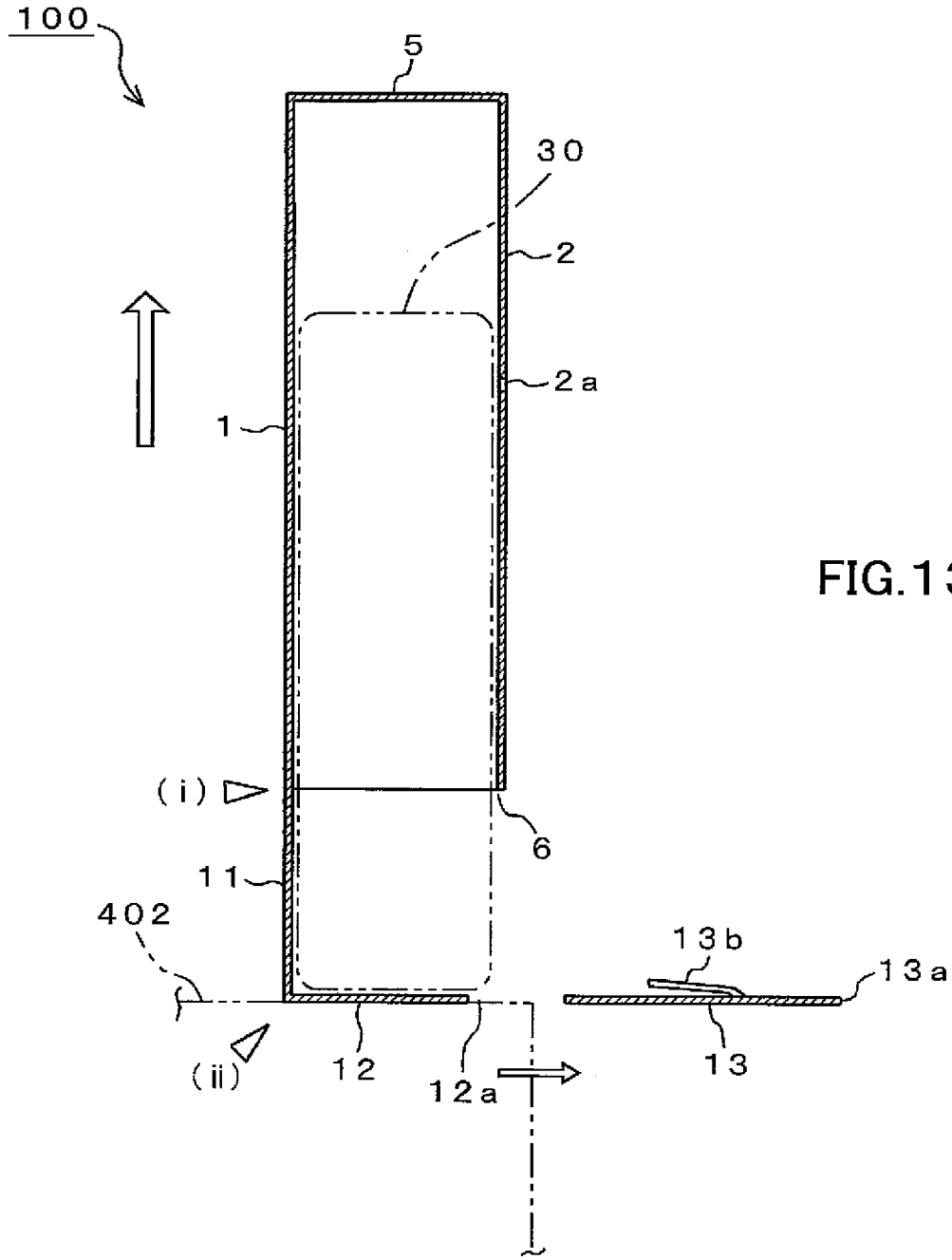
FIG. 13 is a cross sectional view of the container 100 showing the lid-opening example thereof (part four thereof).

The lid-closing portion 13 is then separated from the lid-closing portion 12 through a borderline of the configuration of cuts 12*a* shown in FIG. 13. In this moment, the user operates to pull the protrusion 13*a* of the lid-closing portion 13 strongly toward this side with him holding it. By this operation, it is possible to separate from the configuration of cuts 12*a* only the lid-closing portion 13 of the second folding surface supporting the articles 30. The container 100 is then pulled upward. In this moment, the lid-closing portion 12 is bent back based on the folding position (ii) that is almost perpendicular from the lid-closing portion 12, a posture of which is kept to the lid-constituting portion 11. By this bending operation, it is possible to from the same wall surface constituted of the lid-closing portion 12 in addition to the container-constituting portion 1 and the lid-constituting portion 11. This enables a falling-in-parallel posture of each of the articles to be further controlled with the continuous wall surface constituted of the container-constituting portion 1, the lid-constituting portion 11 and the lid-closing portion 12.

Figure 14:
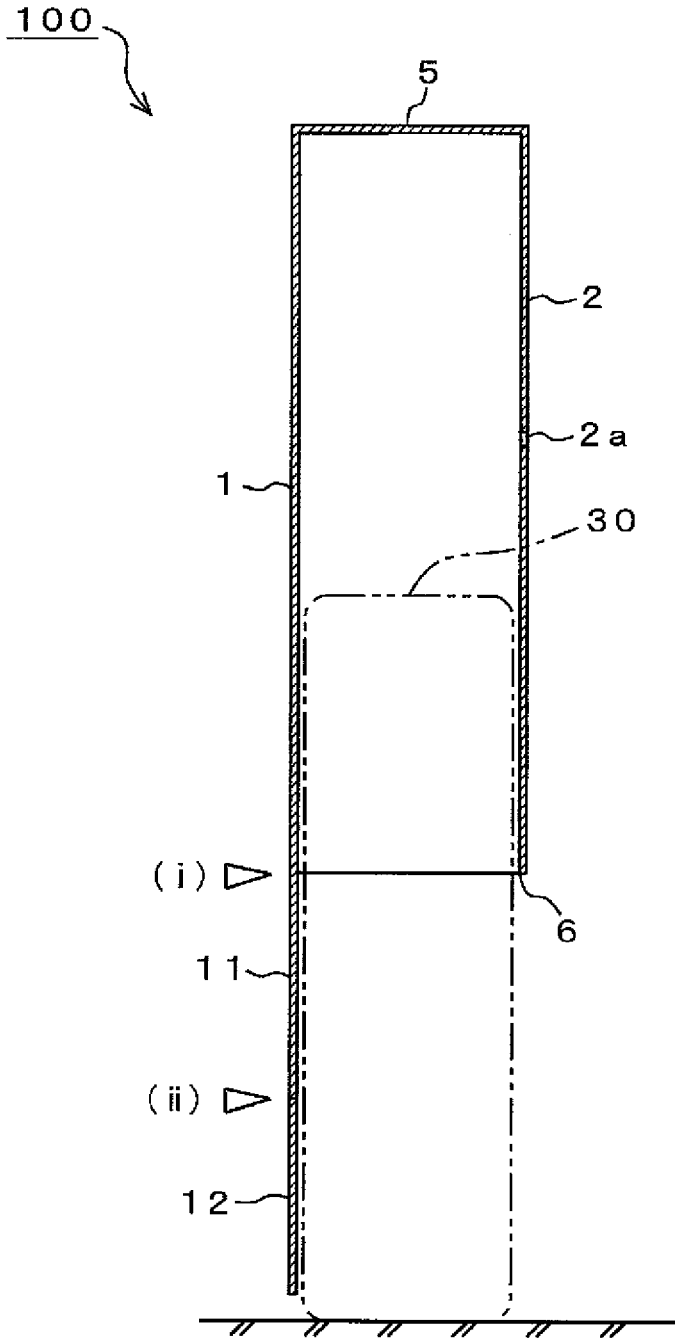
FIG. 14 is a cross sectional view of the container 100 showing the lid-opening example thereof (part five thereof).

According to the container 100 shown in FIG. 14, the lid-closing portion 12 following the container-constituting portion 1 and the lid-constituting portion 11 form the same wall surface so that they wait with them contacting a side surface of each of the articles 30. This enables the articles 30 to be loaded onto the automatic machine 400.

Thus, according to the container 100 as the first embodiment, when taking the articles 30 outside while a side of the opening 6 is directed downward, the side surface of each of the articles 30 is formed as to contact the continuous wall surface constituted of the wall surface formed by the container-constituting portion 1 and the wall surface formed by the lid-constituting portion 11 along it. This enables the falling-in-parallel posture of each of the articles 30 to be controlled so as to go along the wall surface of the lid-constituting portion 11 that is continuous from the wall surface of the container-constituting portion 1 when loading the articles 30 onto the cassette or the like for containing the articles.

Accordingly, it is capable of taking the articles 30 out of inside of the container 100 with good reproducibility toward a downward direction while the side of the opening 6 is directed downward. This enables the container 100 to be suitably applied to a paper-made refill or the like, which is applicable to a vending machine, various kinds of parts cassettes or the like. Particularly, this container 100 is suitably applicable to a refill for loading the consumables onto the binding system.

Embodiment 2

Figure 15:
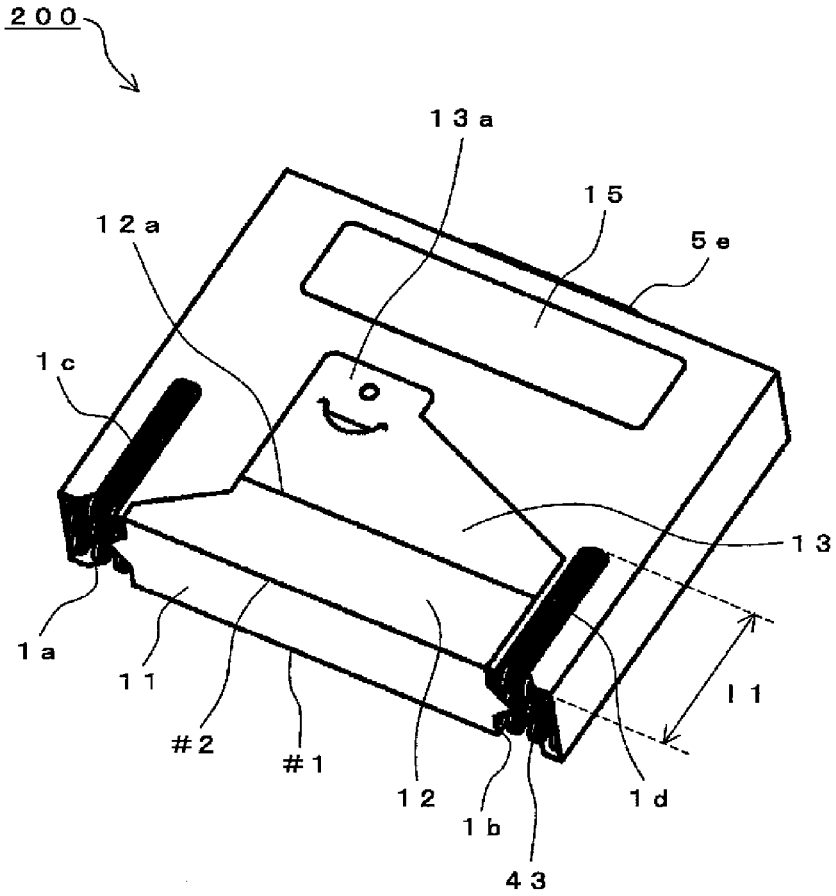
FIG. 15 is a perspective view of a container 200 for loading the consumables as a second embodiment showing a configuration example thereof.

The following will describe a configuration example of a container 200 for loading consumables according to a second embodiment with reference to FIG. 15. According to the container 200 shown in FIG. 15, the single lid structure of the container 100 according to the invention is also provided and plural binding members as one example of the articles 30 are handled so as to contain them therein (see FIGS. 16A through 16C).

In this embodiment, slits 1*a*, 1*b* for assisting opening or closing and positioning are provided in a container-constituting portion 1 on a vertical direction thereof and slits 1*c*, 1*d* for assisting opening and closing are provided in a container-constituting portion 2 on a vertical direction thereof. The slits 1*a*, 1*b* are provided at right and left two positions on the same plane of the container-constituting portion 1. Similarly, the slits 1*c*, 1*d* are provided at right and left two positions on the same plane of the container-constituting portion 2. Length of each of the slits 1*a* through 1*d* is l1.

The length l1 is set so as to be almost a half of a height H of the container 200. This is figured out to move the lid-constituting portion 11 easily further back and forth. It is possible to open the opening 6 wider than that of the first embodiment, which is easy to load the articles 30 in the container onto the cartridge or the like.

Figure 17:
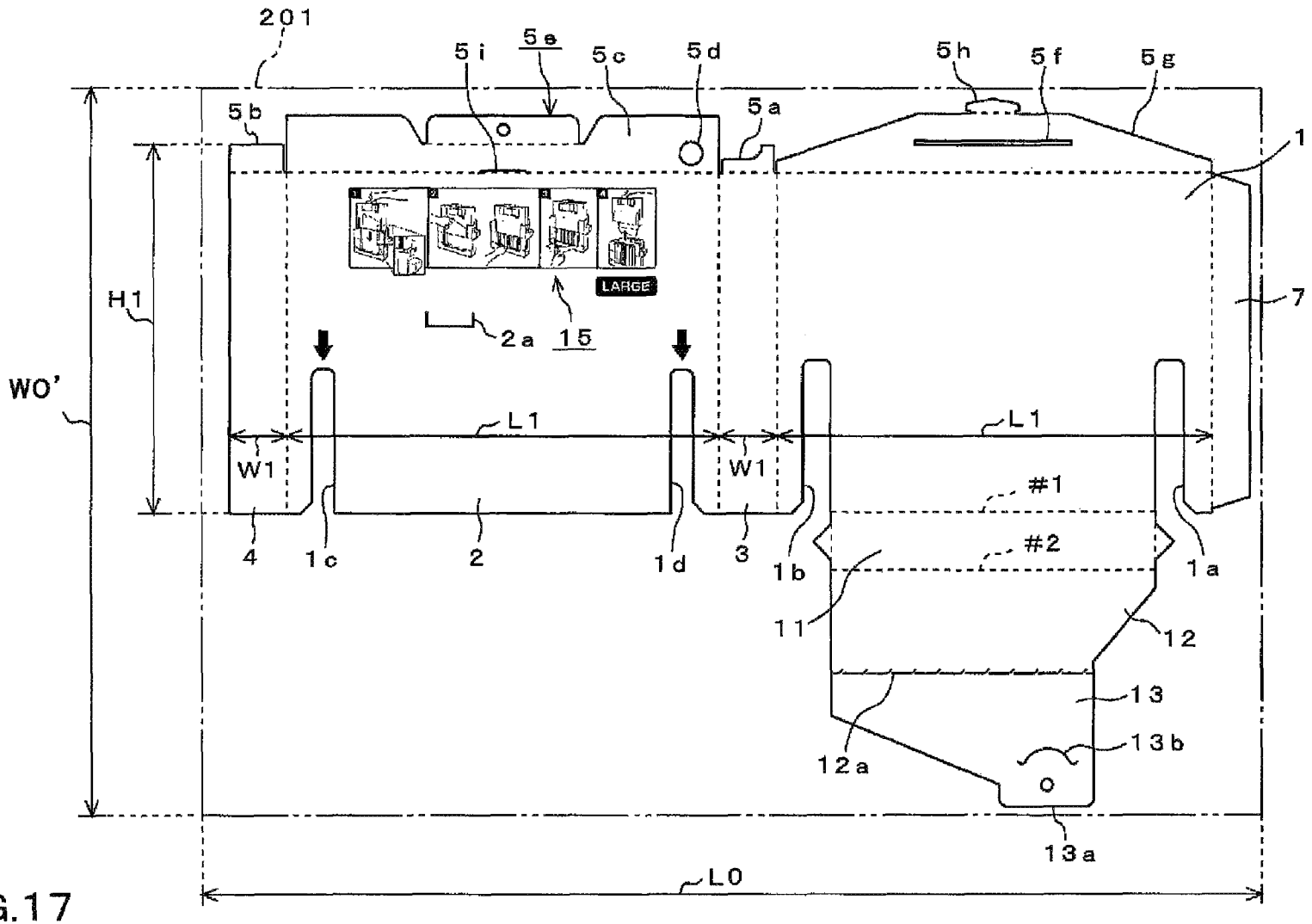
FIG. 17 is a diagram showing an example of measurements in container material 201.

In this embodiment, it is designed that a part of the container 200 that is positioned at an opposite side of a part thereof in which the single lid structure is arranged is a container-constituting portion 5*c* and the container-constituting portion 5*c* is provided with a handle 5*e* as shown in FIG. 17. It is designed that the container 200 is easy to be carried.

In this embodiment, a display region 15 for an instruction manual is provided at an upper portion of the container-constituting portion 2 and any instruction procedure when loading the container 200 are printed thereon. The user may operate the lid-closing portions 13 and 12 (tab) or the like based on this instruction procedure. Further, it is designed that a part of the container-constituting portion 1, which is positioned at an opposite side of a part thereof in which the single lid structure is arranged, is a container-constituting portion 5*g*. The container-constituting portion 5*g* is provided with an opening 5*f* for the handle and an engaging piece 5*h*. The container-constituting portion 5*c* is provided with a slit 5*i* for being engaged with the engaging piece (see FIG. 17). It is to be noted that names and signs similar to those of the first embodiment have the same functions as those thereof, an explanation of which will be omitted.

Here, the binding member(s) 43 that can be contained in the container 200 will be described with reference to FIGS. 16A through 16C. The binding member 43 shown in FIG. 16A constitutes an example of the articles 30 and plural kinds thereof are manufactured according to thicknesses of bundles of paper to be bound in a binder. The binding member 43 is formed by utilizing a die-forming device. For example, the binding member 43 is made of a resin-molding product that is constituted of a backbone portion 43*a* having a length that conforms to a size of a standard size paper (for example, A size) and ring portions 43*b* that are arranged with a fixed space, each becoming a ring shape. The binding members 43 are contained in the container 200 in groups of plural pieces thereof for every kind.

Figure 16A:
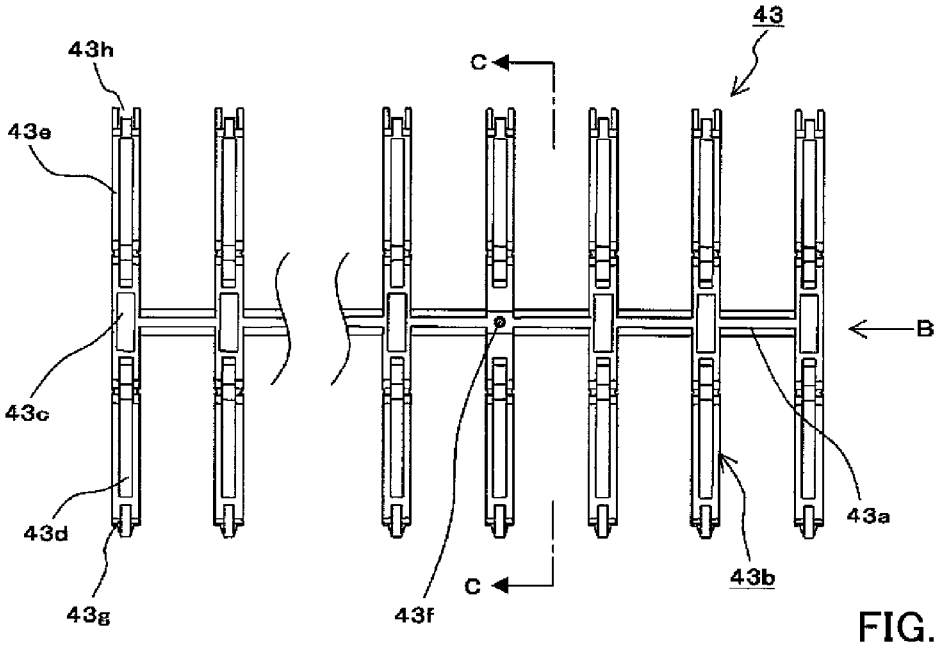
FIG. 16A is a top plan view of a binding member 43, to be contained in the container 200 shown in FIG. 15, showing a configuration example thereof.
Figure 16B:
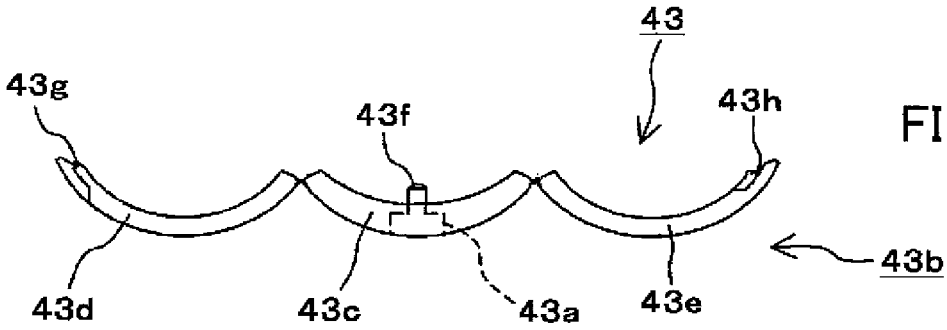
FIG. 16B is a front view of the binding member 43 showing a configuration example thereof, which is seen from a direction of an arrow B of FIG. 16A.

It is configured that as shown in FIG. 16B, each ring portion 43*b* is split into three parts which are an arc shaped ring part 43*c* that is connected with the backbone portion 43*a* and arc shaped ring parts 43*d* and 43*e* that are connected therewith so that they can be folded from side to side. A cross section of the backbone portion 43*a* has a shape in which a base is a straight line and an upper middle is convex. It is to be noted that as shown in FIGS. 16A and 16B, the arc shaped ring part 43*c* that becomes a predetermined ring portion 43*b* is provided with a projected pin 43*f*. The ring portion 43*c* is provided with a housing hole, not shown, corresponding to the pin 43*f* on a side thereof that is opposite to the side at which the pin 43*f* is provided.

Figure 16C:
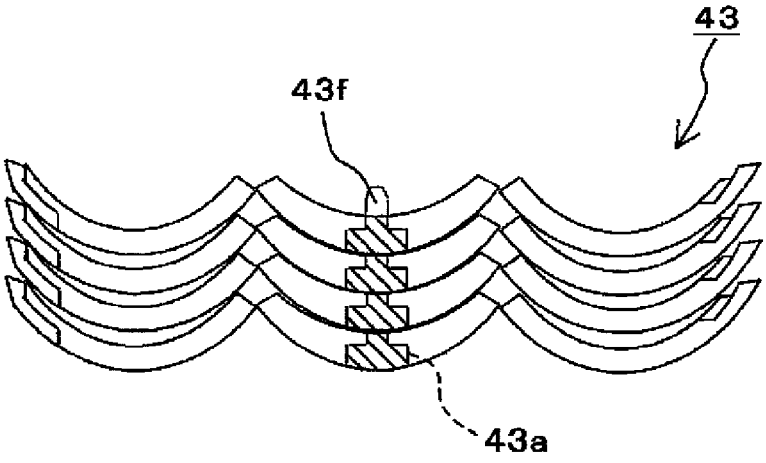
FIG. 16C is a cross sectional view, taken along arrows C-C, of the binding members 43 showing a stacked example thereof, which is seen from a direction of the arrow B of FIG. 16A.

According to the stacked binding members 43 shown in FIG. 16C, it is configured that plural binding members 43 are stacked by inserting each pin 43*f* into each housing hole while both ends of each of the arc shaped ring parts 43*d*, 43*c* and 43*e* that become the ring portion 43*b* shown in FIGS. 16A and 16B are aligned on almost a straight line. This enables the binding members 43 to be contained in the container 200 shown in FIG. 15 in groups of plural pieces thereof for every kind.

The following will describe a method of manufacturing the container 200 with reference to a developed example of the container 200 shown in FIG. 17. In this example, by figuring out how to fold it from one piece of container material 201, the container 200 having a simple structure and a minimum configuration without using another material can be presented.

If the container 200 as shown in FIG. 15 is manufactured, the container material 201 having, for example, a size shown in FIG. 17 is prepared. As the container material 201, coated cardboard with paper quality of 350 g/m$^2$ is used, similar to the first embodiment. In this embodiment, a development may be also drawn so that a coated surface thereof forms an inside of the container 200. The reason therefor has been described in the first embodiment, the description of which will be omitted.

The coated cardboard has a size constituted of a vertical length W0' and a horizontal length L0. In this embodiment, the container material 201 that is larger than that of the first embodiment is prepared to form the handle 5*e* and the container-constituting portion 5*c*. Though depending on a finished measurement of the container 200, the vertical length W0' may be almost (5 through 7)W1+H1 or more and the horizontal one L0 may be almost 2L1+2W1+a margin for connection or more. The container material 201 is not limited to the coated cardboard but the ones described in the first embodiment may be used therefor.

The container material 201 shown in FIG. 17 is drawn, the slits 1*a*, 1*b* are provided in the container-constituting portion 1 and the slits 1*c*, 1*d* are provided in the container-constituting portion 2. In this moment, triangles are drawn so that they project from both sides of the lid-constituting portion 11. When proving with these slits 1*a*, 1*b*, base area of the lid-constituting portion 11 is reduced while the base area may be complemented by these triangles.

In this embodiment, the handle 5*e* is drawn on the container-constituting portion 5*c*. The container-constituting portion 5*c* is continuously extended from a side of the container-constituting portion 2, which is opposite to the side thereof in which the single lid structure is arranged. The opening (slit) 5*f* for the handle draws the container-constituting portion 5*g*. The container-constituting portion 5*g* is continuously extended from a side of the container-constituting portion 1, which is opposite to the side thereof in which the single lid structure is arranged. Thus, when erecting the container, by inserting the handle 5*e* into the opening 5*f*, the container-constituting portions 5*c*, 5*g* become double structure, thereby obtaining strength of the container 200.

The engaging piece 5*h* is provided on the container-constituting portion 5*g* in addition to the opening 5*f* for the handle and the slit 5*i* for being engaged with the engaging piece is provided on the container-constituting portion 5*c*. This enables the container-constituting portion 5*g* to be held onto the slit 5*i* by inserting the engaging piece 5*h* into the slit 5*i* when erecting the container. The slit constituting the engaged portion 2*a* is provided on the container-constituting portion 2. It is configured so that the engaging portion 13*b* can be held onto the engaged portion 2*a* when erecting the container.

Further, a circular window 5*d* for checking color or the like of the contents is arranged on the container-constituting portion 5*c*. Other parts thereof are similar to those of FIG. 2, the description of which will be omitted. Thus, a development of the container 200 is constituted and cutting and folding it allows the container 200 shown in FIG. 15 to be completed. This enables the container 200 for loading the consumables, which has a base shape that allows the binding members 43 to fall in parallel and the configuration of cuts 12*a*, to be constructed. The lid-constituting portion 11 having a configuration of one base is also provided so that the base shape of the lid-constituting portion 11 may prevent any binding members (consumables) 43 from being deformed.

Next, the following will describe a lid-opening example of the container 200 with reference to FIGS. 18A, 18B, 19A, 19B, 20A, 20B, 21A, 21B, 22A, 22B, 23A and 23B. In this embodiment, a case is illustrated where the engaging portion 13*b* of the lid-closing portion 13 is disengaged while a part in which the single lid structure is arranged is directed downward so that the opening 6 is opened.

Figure 18A:
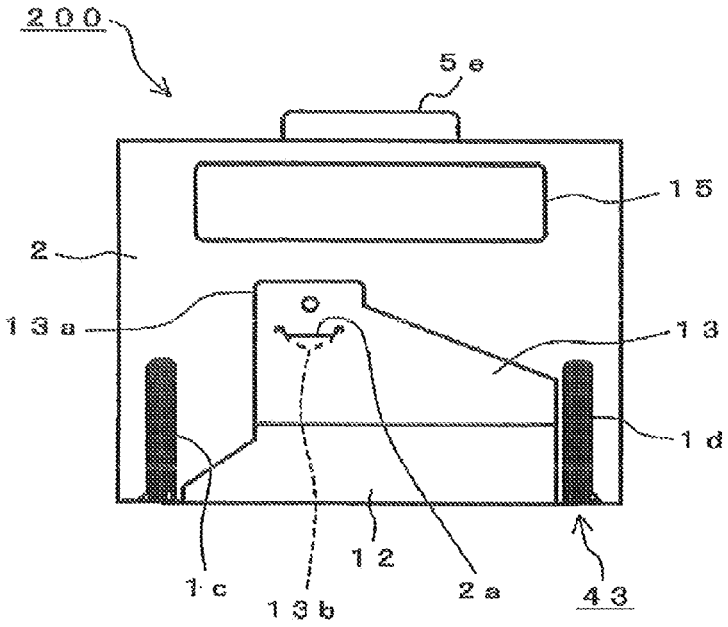
FIG. 18A is a front view of the container 200 showing a lid-opening example thereof (part one thereof).
Figure 18B:
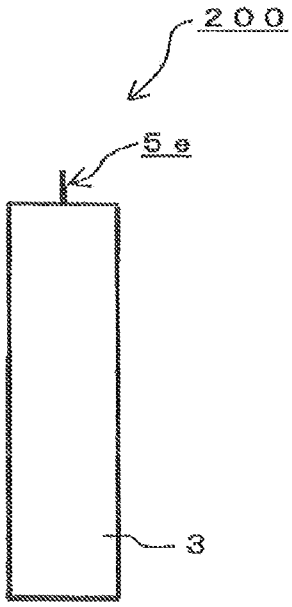
FIG. 18B is a side view of the container 200, shown in FIG. 18A, showing a configuration example thereof.

The plural binding members 43 shown in FIG. 16A are contained in the container 200 shown in FIG. 18A with them being stacked. In this embodiment, the semicircular engaging portion 13*b* of the lid-closing portion 13 is inserted into the engaged portion 2*a* of the container-constituting portion 2 so that they are sealed. It is designed that the container 200 is carried with holding the handle 5*e* shown in FIG. 18B.

Figure 19A:
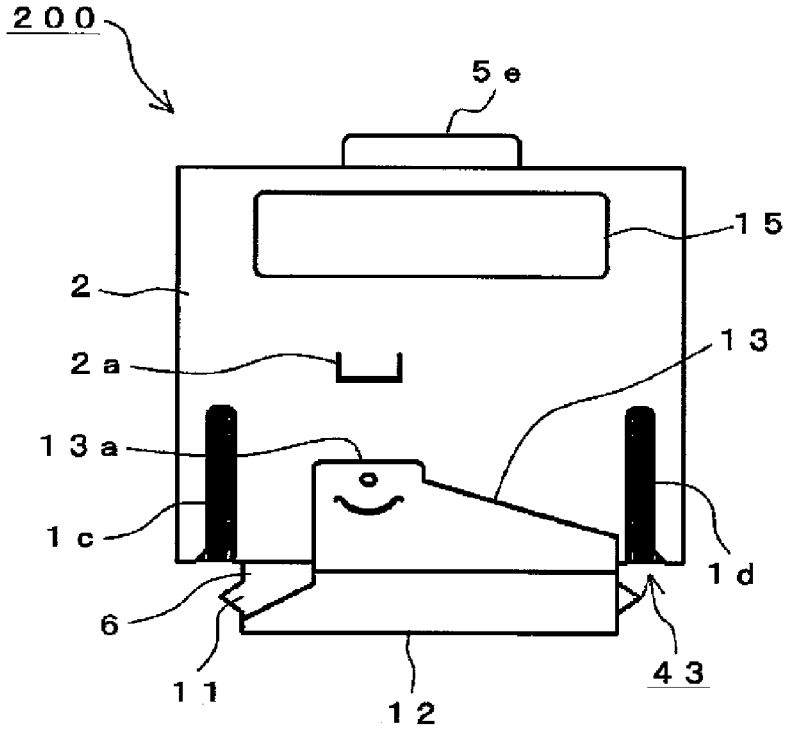
FIG. 19A is a front view of the container 200 showing a lid-opening example thereof (part two thereof).

First, as shown in FIG. 19A, the lid-closing portion 13 is taken out of the container-constituting portion 2 shown in FIG. 18A and the lid-closing portion 13 is pulled toward this side. For example, the user pulls the lid-closing portion 13 toward this side while he holds the protrusion 13*a* (grip) thereof and pulls it tight upward. This allows the engaging portion 13*b* to disengage the engaged portion 2*a* (see FIG. 10B). In this moment, by the slits 1*a*, not shown, 1*b*, not shown, 1*c*, 1*d*, which are provided along a vertical direction, and the like, the container-constituting portion 1 is made curved larger than that of the first embodiment so that the opening 6 may be opened by a larger amount thereof (see FIG. 19B).

Figure 19B:
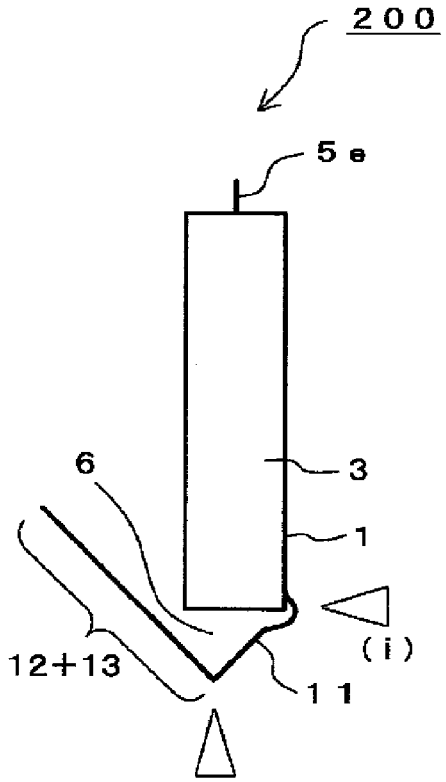
FIG. 19B is a side view of the container 200, shown in FIG. 19A, showing a configuration example thereof when opening the lid.
Figure 20A:
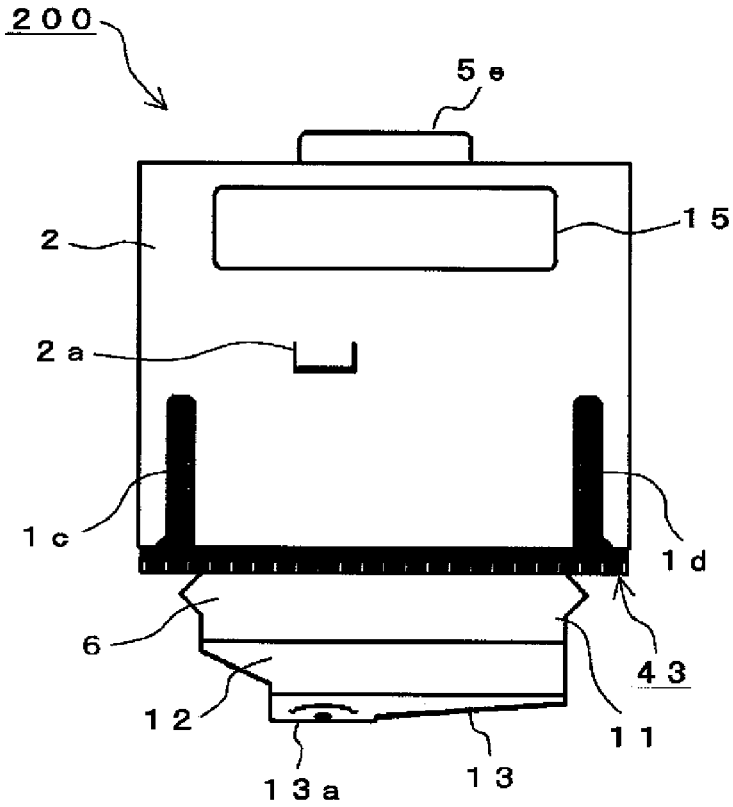
FIG. 20A is a front view of the container 200 showing a lid-opening example thereof (part three thereof).

Next, the container 200 is operated so that the lid-constituting portion 11 is bent back in a direction of making valley folds based on the folding position (i) shown in FIG. 19B. In this moment, the user moves the lid-constituting portion 11 backward while he is pulling the lid-closing portion 13 toward this side, thereby opening the opening 6. According to this opening operation, the binding members 43 contained in the container 200 shown in FIG. 20A are barely held by a part of the lid-constituting portion 11 shown in FIG. 20B so as to become a situation just before the binding members 43 drop.

Figure 20B:
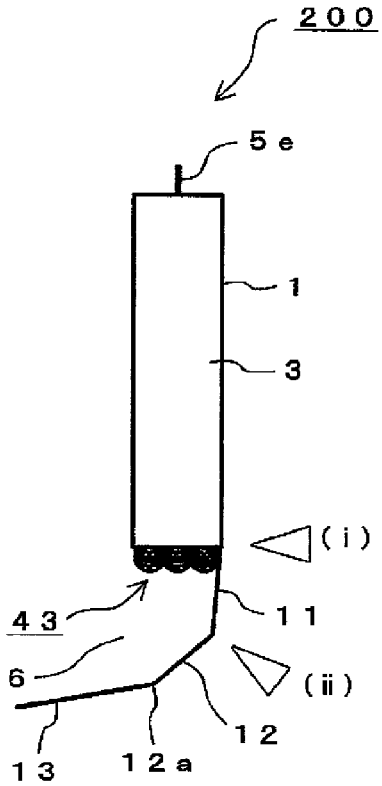
FIG. 20B is a side view of the container 200, shown in FIG. 20A, showing a configuration example thereof when opening the lid.
Figure 21A:
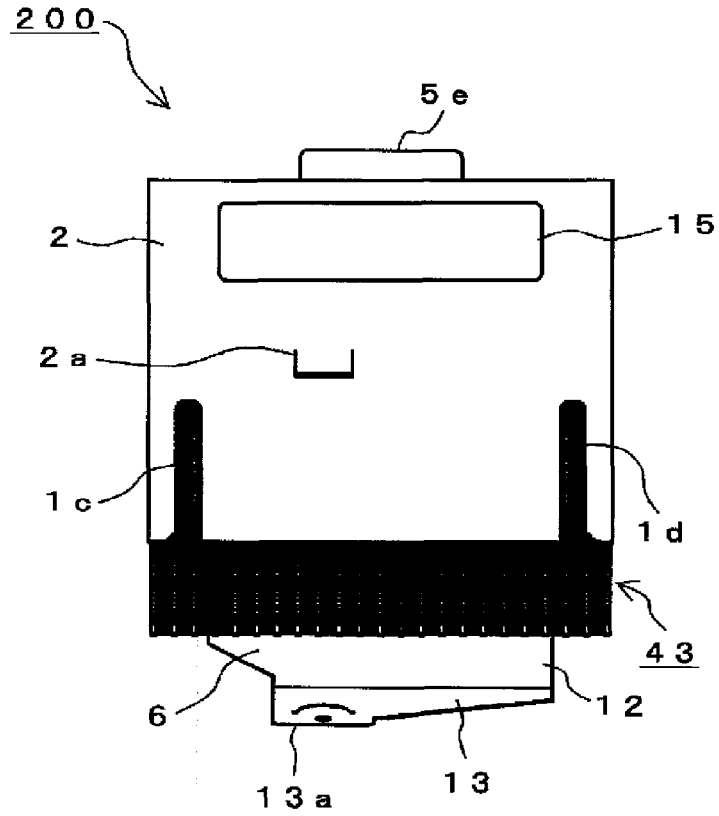
FIG. 21A is a front view of the container 200 showing a lid-opening example thereof (part four thereof).
Figure 21B:
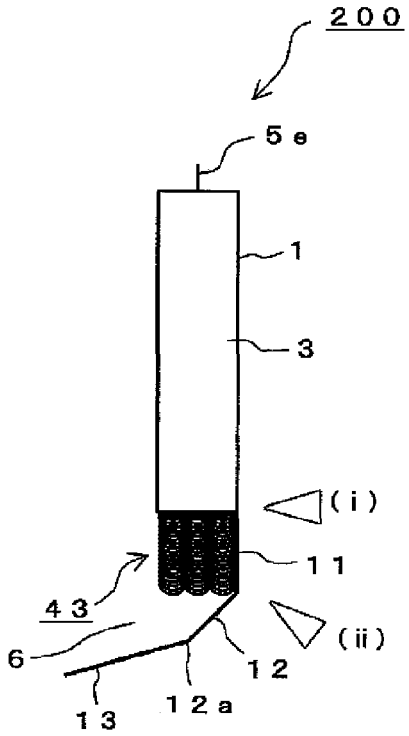
FIG. 21B is a side view of the container 200, shown in FIG. 21A, showing a configuration example thereof when opening the lid.

Then, the bending-back in a direction of making valley folds based on the folding positions (i), (ii) as shown in FIG. 20B goes on so that the lid-constituting portion 11 and the container-constituting portion 1 form the same wall surface. In this moment, the user moves the lid-constituting portion 11 backward while he is pulling the lid-closing portion 13 toward this side, thereby opening the opening 6. By this continued opening-operation, as shown in FIG. 21B, the binding members 43 contained in the container 200 drop (fall in parallel) along a wall surface of the lid-constituting portion 11 (conventional free fall area).

This free fall area occurs because a length of the groove on which the container 200 is inserted into the cartridge 42 is set to be made small in regard to an object to pack the binding members (stacked consumables) 43 by paper-made package as simple as possible and maintain its box shape. The falling-in-parallel posture of the binding members 43 is controlled in this free fall area. By this control, the binding members 43 contained in the container 200 shown in FIG. 21A become brought into a state where about a quarter thereof is exploded below from the opening 6.

Figure 22A:
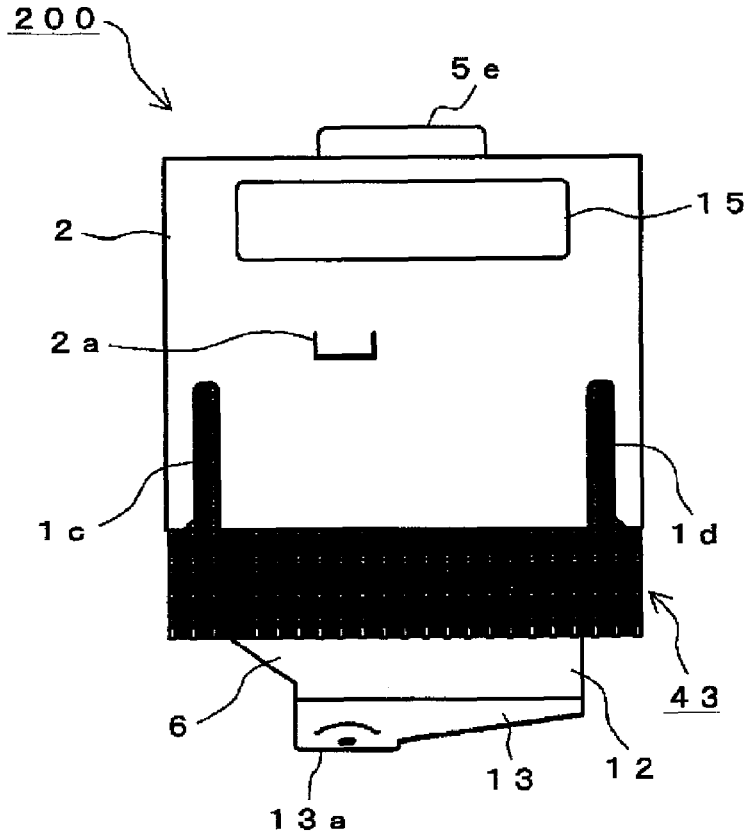
FIG. 22A is a front view of the container 200 showing a lid-opening example thereof (part five thereof).
Figure 22B:
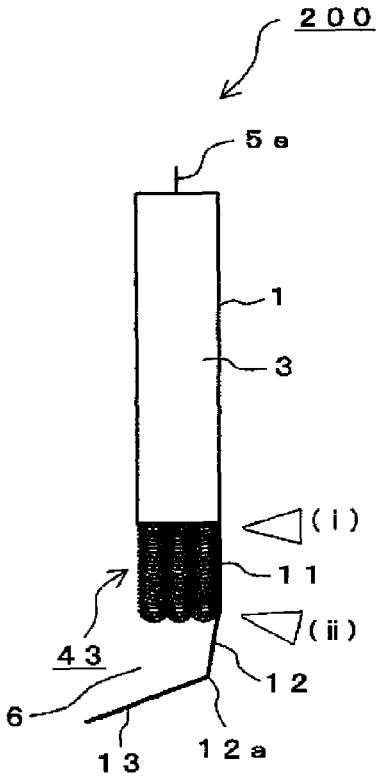
FIG. 22B is a side view of the container 200, shown in FIG. 22A, showing a configuration example thereof when opening the lid.

The lid-closing portion 12 is bent back based on the configuration of cuts 12*a* as shown in FIG. 22B. This enables the falling-in-parallel posture of the binding members 43 to be further controlled by the continuous wall surface constituted of the container-constituting portion 1, the lid-constituting portion 11 and the lid-closing portion 12. In this embodiment, along a continuous wall surface constituted of a wall surface formed by the container-constituting portion 1, a wall surface formed by the lid-constituting portion 11 and a wall surface formed by the lid-closing portion 12, a side surface of each of the articles contacts it. By such a contact, the binding members 43 contained in the container 200 shown in FIG. 21A further fall in parallel as shown in FIG. 22A. By such a falling-in-parallel, as shown in FIG. 23B, the binding members 43 are brought into a state where they are hold by the lid-closing portion 13.

In this embodiment, the configuration of cuts 12*a* is positioned at back side, which is different from the first embodiment, and the lid-closing portions 12 and 13 are brought into a state where they are perpendicular to each other based on the configuration of cuts 12*a*. Thus, the binding members 43 contained in the container 200 shown in FIG. 23A become brought into a state where about a half thereof is exploded below from the opening 6.

Figure 23A:
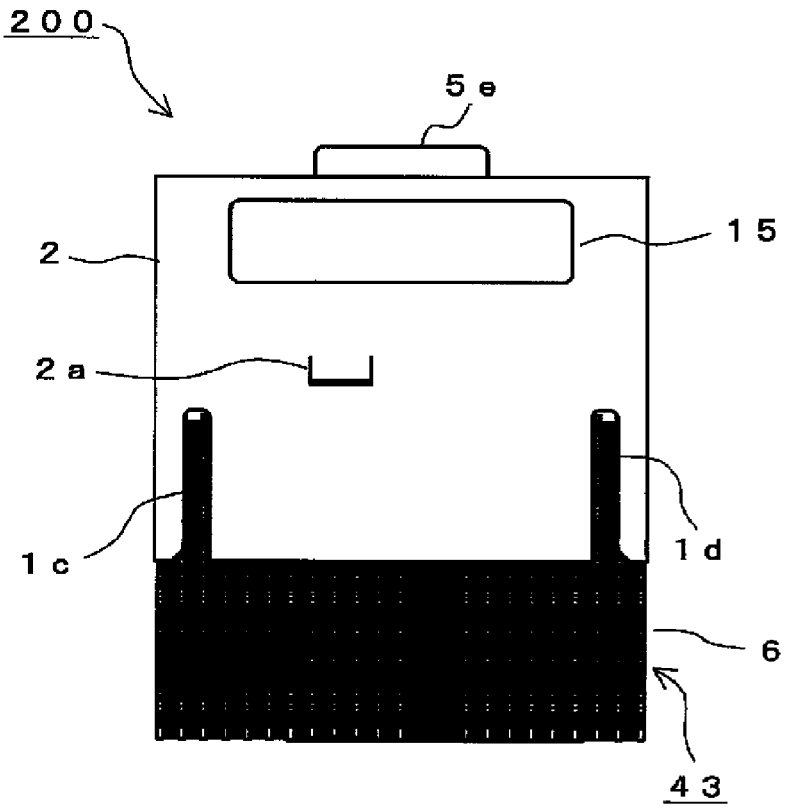
FIG. 23A is a front view of the container 200 showing a lid-opening example thereof (part six thereof).
Figure 23B:
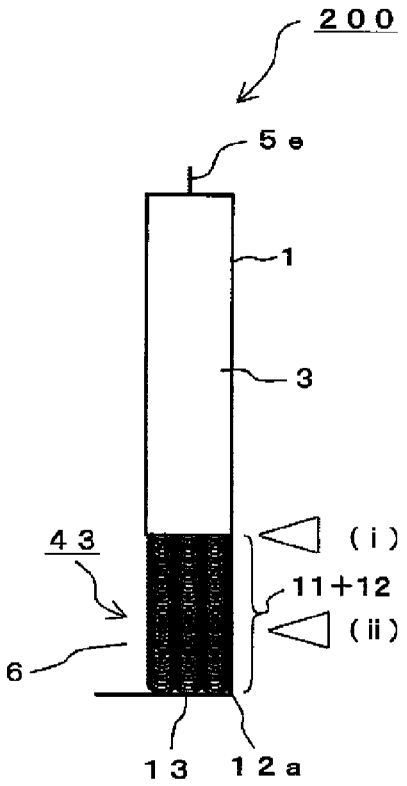
FIG. 23B is a side view of the container 200, shown in FIG. 23A, showing a configuration example thereof when opening the lid.

The lid-closing portion 13 is then separated from the lid-closing portion 12 from a borderline of the configuration of cuts 12*a* shown in FIG. 23B. In this moment, the user operates to pull the protrusion 13*a* of the lid-closing portion 13 strongly toward this side with him holding it. This enables only the lid-closing portion 13 of the second folding surface supporting the binding members 43 to be separated from the configuration of cuts 12*a*. It is possible to remove the lid-closing portion 13 from the bottom surface of the binding members 43 (see FIG. 23A). The container 200 is then lifted upward.

According to the container 200 shown in FIG. 23B, the container-constituting portion 1, the lid-constituting portion 11 and the lid-closing portion 12 form the same wall surface so that they wait with them contacting a side surface of each of the binding members 43. This enables the binding members 43 to be easily loaded onto the cartridge of the binder or the like.

Figure 24:
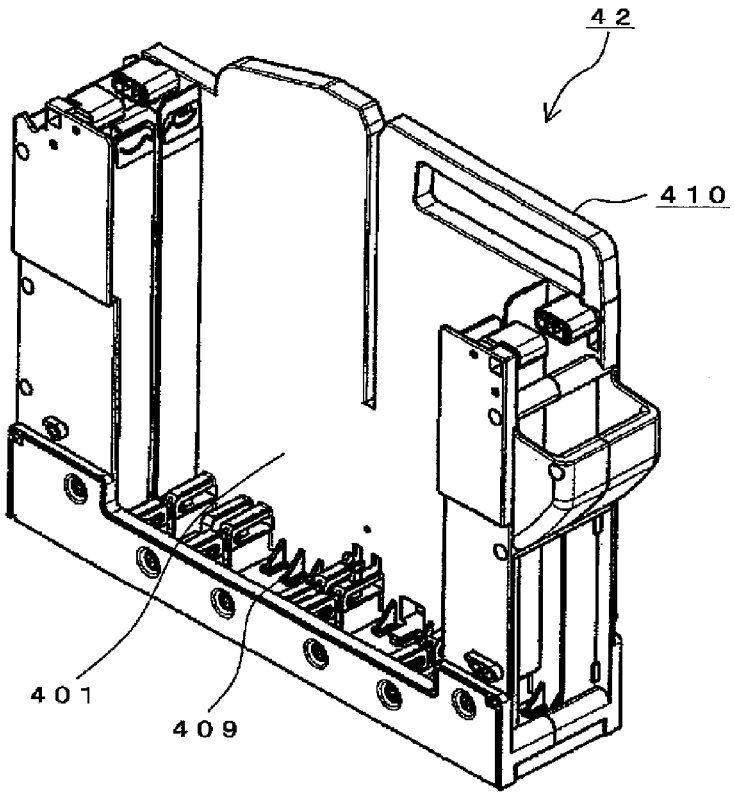
FIG. 24 is a perspective view of a cartridge 42 showing a configuration example thereof.

The following will describe a case where the cartridge 42 is used instead of the automatic machine for loading the container. The cartridge 42 shown in FIG. 24 has a main body portion 410 with a predetermined shape. A loading space 401 for loading the container 200 shown in FIG. 15 is provided in the main body portion 410.

The loading space 401 is blocked in its three directions within the main body portion 410. Namely, there is a situation such that an operator's hand cannot enter into right and left side surfaces and a back surface of the loading space 401. A holding-claw mechanism 409 is set at a side of a bottom surface of the loading space 401 and when performing binding process, it holds the binding members 43. For example, the holding-claw mechanism 409 operates so as to hold the lowermost binding member 43 or transfer the binding members to a moving mechanism of the binder, not shown, from the lowermost one in turn.

When the container 200 with a single lid structure according to the present invention is loaded onto the cartridge 42 having such a loading space 401, the container 200 is laded so that it is directed from an upper part of the loading space 401 to a lower part thereof. According to the cartridge 42 shown in FIG. 24, a mechanism of stopping the container 200 is provided at a middle of the loading space 401.

For example, a stopper mechanism, not shown, is provided at the right or left side surface or a back surface of the loading space 401. It is configured that when dropping the container 200 from the upper part of the loading space 401 to a lower part thereof along it, the stopper mechanism stops movement of the container 200. Such a mechanism enables to be realized a structure in which the operator's hand can enter into a lower part of the loading space 401 under the container 200 stopping at a middle thereof, thereby keeping any working space.

The following will describe a loaded example of the container 200 with reference to FIGS. 25A through 25E. In this loaded example, the container-loading procedure is shown, which indicates to contents printed in the display region 15 for an instruction manual in the container-constituting portion 2 of the container 200 shown in FIG. 17. In this example, it is designed that the lid-constituting portion 11 and the lid-closing portion 12 are removed by pulling the lid-closing portion 13 positioned toward this side while the container 200 is loaded onto the loading space 401 of the above-mentioned cartridge 42.

Figure 25A:
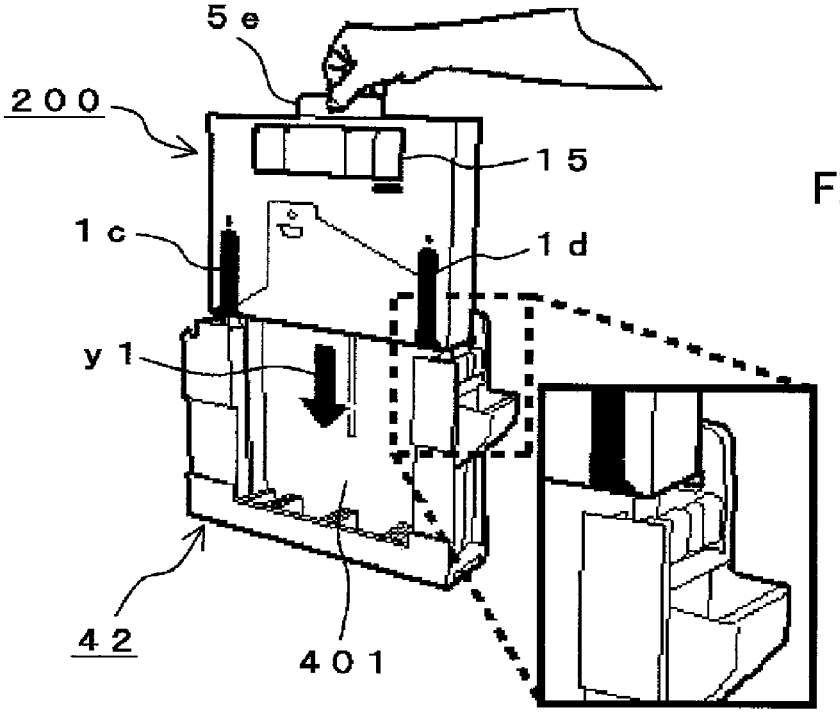
FIG. 25A is a perspective view of the container 200 showing a loaded example thereof (part one thereof).

FIG. 25A is a perspective view enlarging an operation procedure No. 1 in the display region 15 for an instruction manual shown in FIG. 17. As the operation procedure No. 1 in the display region 15 for an instruction manual, a perspective view showing a configuration example of the cartridge 42 shown in FIG. 24 and an illustration when loading the container 200 are displayed. In this illustration, as shown in FIG. 25A, a direction for loading the container 200 is shown as an arrow y1. As an illustration for awaking the loading on that occasion, an enlarged drawing in which the container 200 is loaded onto the cartridge 42 so that the slit 1*d* and the like of the container 200 are inserted into predetermined positions of the main body portion 410 of the cartridge 42 is displayed. The user may load the container 200 onto the cartridge 42 according to this enlarged drawing.

Figure 25B:
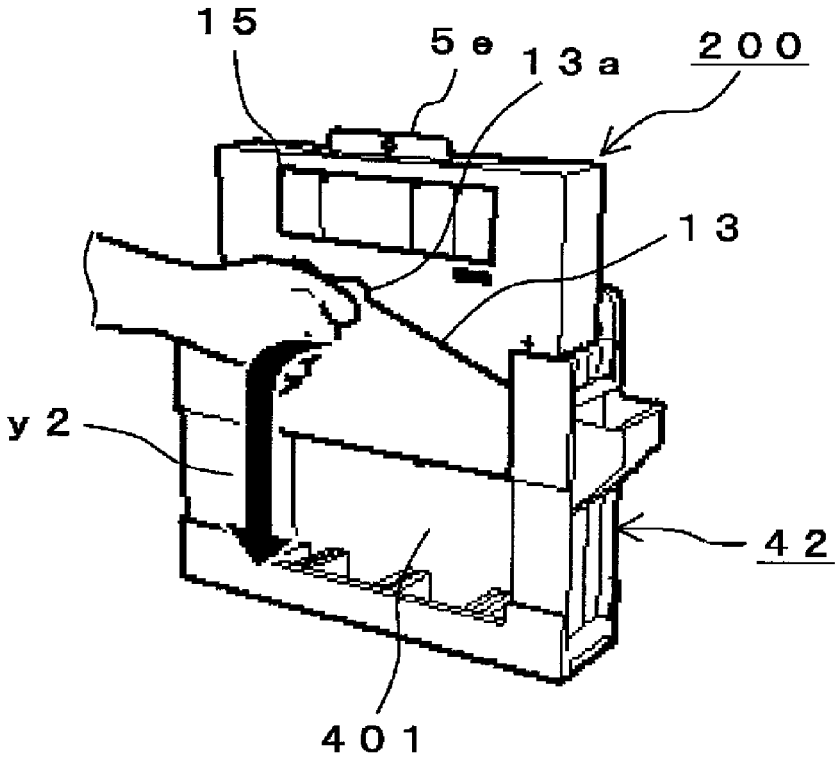
FIG. 25B is a perspective view of the container 200 showing a loaded example thereof (part two thereof).

FIG. 25B is a perspective view that enlarges a left side drawing of an operation procedure No. 2 in the display region 15 for an instruction manual shown in FIG. 17. In FIG. 25B, an illustration when pulling the protrusion 13*a* of the container 200 loaded in the cartridge 42 toward this side with holding it is displayed. In this illustration, a direction for pulling the protrusion 13*a* is shown as an arrow y2. The user may pull the protrusion 13*a* of the lid-closing portion 13 positioned to this side. This enables the lid-constituting portion 11 and the lid-closing portion 12 to be removed.

Figure 25C:
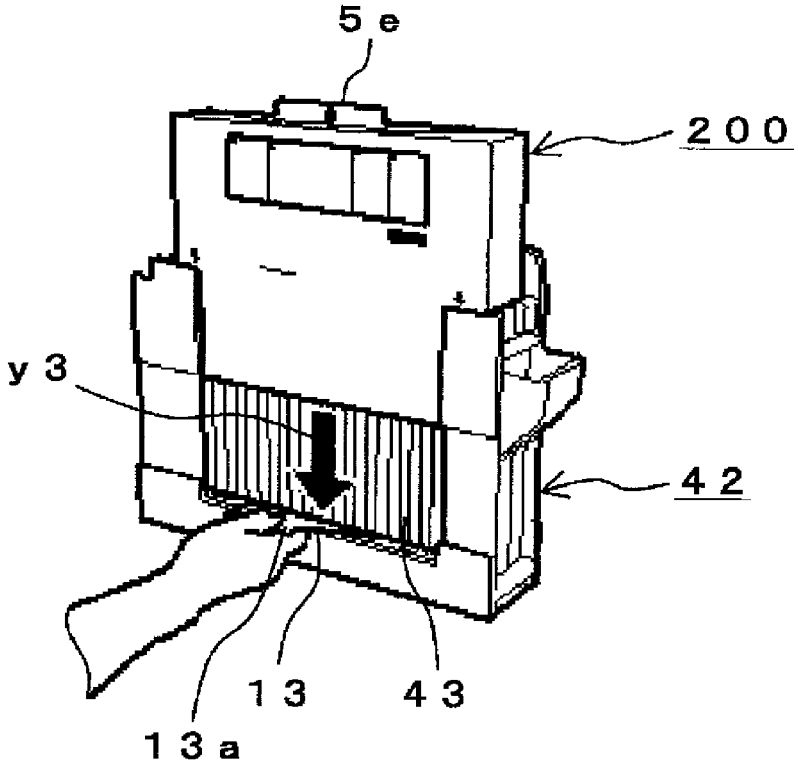
FIG. 25C is a perspective view of the container 200 showing a loaded example thereof (part three thereof).

FIG. 25C is a perspective view that enlarges a right side drawing of an operation procedure No. 2 in the display region 15 for an instruction manual shown in FIG. 17. In FIG. 25C, an illustration in which the protrusion 13*a* is pulled toward this side with holding it and an illustration in which the binding members 43 fall in parallel from the container 200 loaded in the cartridge 42 are displayed. In these illustrations, a direction for the binding members to fall in parallel is shown as an arrow y3. The user may operate the protrusion 13*a* based on this direction.

Figure 25D:
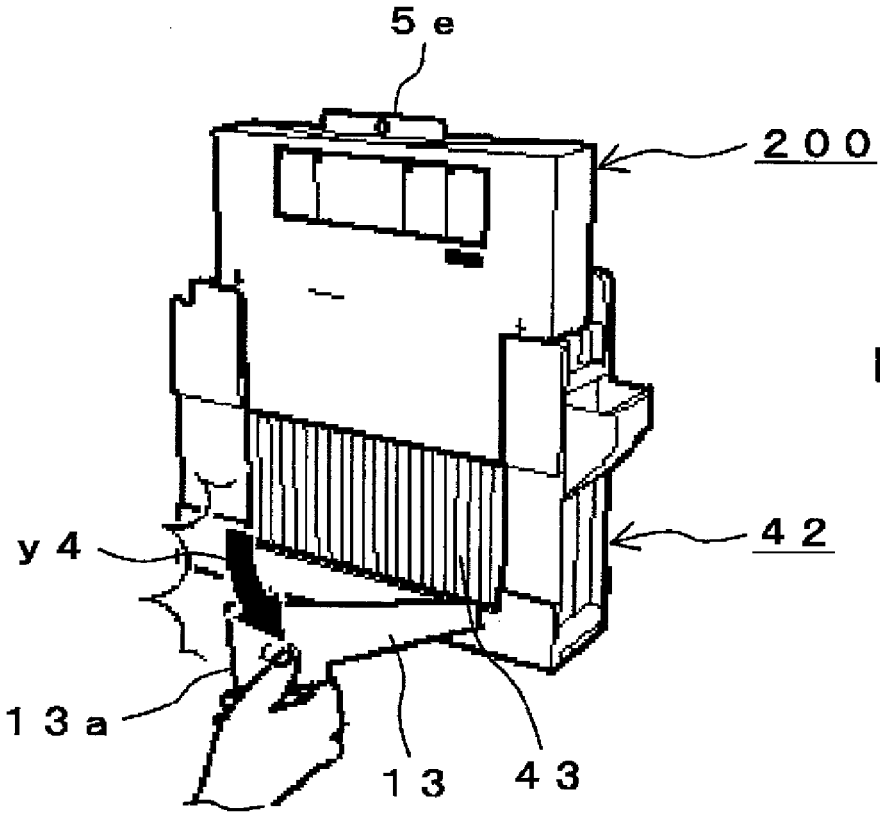
FIG. 25D is a perspective view of the container 200 showing a loaded example thereof (part four thereof).

FIG. 25D is a perspective view enlarging an operation procedure No. 3 in the display region 15 for an instruction manual shown in FIG. 17. In FIG. 25D, an illustration when pulling the protrusion 13*a* so as to rotate toward this side and right side with holding it and an illustration in which the lid-closing portion 13 is released from the lower side of the container 200 loaded in the cartridge 42 are displayed. In these illustrations, a direction for rotating the lid-closing portion 13 toward this side and right side is shown as an arrow y4. The user may operate the protrusion 13*a* based on this direction. In this embodiment, the configuration of cuts 12*a* is provided on a predetermined position of the lid-closing portion 12 away from the engaging portion 13*b* by a predetermined distance. A posture of the lid-closing portion 13 is kept so that it is set to a position which is almost perpendicular to the lid-constituting portion 11 and the lid-closing portion 12. The lid-closing portion 13 that is brought into a state kept to such a posture is released from the configuration of cuts 12*a* (see FIG. 23B).

Figure 25E:
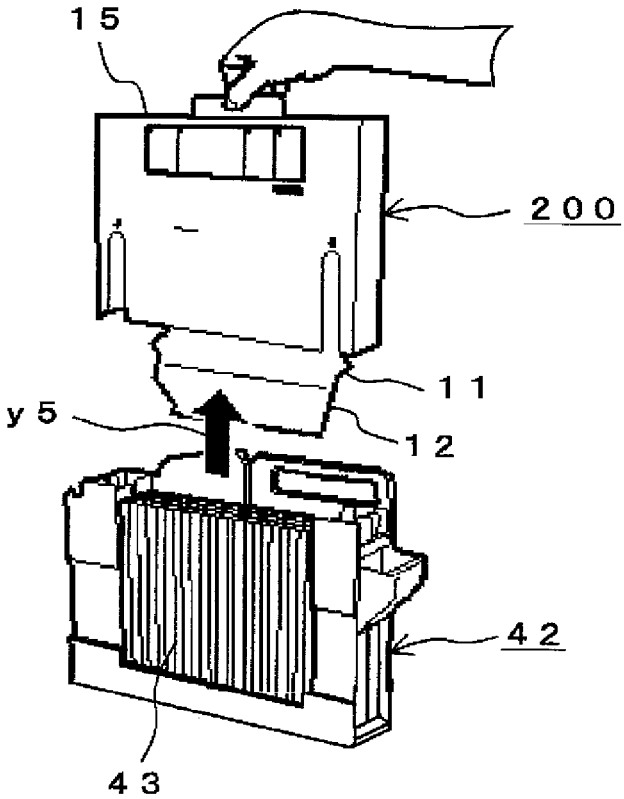
FIG. 25E is a perspective view of the container 200 showing a loaded example thereof (part five thereof).

FIG. 25E is a perspective view enlarging an operation procedure No. 4 in the display region 15 for an instruction manual shown in FIG. 17. In FIG. 25E, an illustration in which the container 200 is lifted upward with holding the handle 5*e* and an illustration in which the container 200 is removed from the cartridge 42 are displayed. In these illustrations, a direction for removing the container 200 is shown as an arrow y5. The user may operate to remove the container 200 based on this direction.

Thus, according to the container 200 for loading the consumables as the second embodiment, it is configured by the container material 201 such as coated cardboard for enclosing the binding members 43 (consumables). It is designed that such a container 200 is always kept to contact the binding members 43 with the container 200 on the way of opening (releasing) operation of the lid-constituting portion 11 that protects the bottom thereof.

Accordingly, it is possible to contact the suitably long folding line #1 between the container-constituting portion 1 and the lid-constituting portion 11, the folding line #2 between the lid-constituting portion 11 and the lid-closing portion 12 and the configuration of cuts 12*a* between the lid-closing portions 12 and 13 with the binding members 43 in stages. This enables each of the binding members 43 on the way of being loaded, to be kept to a posture which is in parallel with the horizontal surface thereof. This allows the binding members 43 to fall in parallel from the container 200 to a side of the bottom of the loading space 401.

Since the slits 1*a* through 1*d* and like are provided on both sides of each of the container-constituting portions 1, 2 in a vertical direction thereof, it is possible to make the container-constituting portion 1 largely curved when opening the lid. Accordingly, the opening 6 can be opened in a larger amount thereof, thereby enabling the front operability thereof to be improved as compared by that of the first embodiment.

Further, any wasted portion after completing the falling-in-parallel of the binding members 43, namely, the lid-closing portion 13 supporting the bottom of the binding members 43 finally is cut and removed by utilizing the configuration of cuts (perforations) 12*a*. Accordingly, the bottom of the container is opened and the container 200 can wait smoothly upward so that it is capable of loading the binding members 43 onto the cartridge 42 with high reproducibility and high reliability.

In the above-mentioned embodiment, a case in which, by catching the slits 1*a* through 1*d* for assisting the opening or closing and for positioning, which are provided on the container previously, on predetermined positions of the loading space 401 of the cartridge 42, the lid-constituting portion 11 and the like are operated so as to be opened has been described. However, it is not limited thereto: First, the slits 1*a* through 1*d* are previously processed as the configuration of cuts (perforations like a box of sweets). Next, just before stating the opening operation, any waste portion forming the slits 1*a* through 1*d* may have been cut off and removed. Thus, it is possible to load the container 200 itself up to the bottom of the cartridge 42 deeply.

INDUSTRIAL APPLICABILITY

The present invention is very preferably applicable to a carton containing a plurality of small sized articles, to be handled, such as PET bottles, cans, cigarettes, pencils, and filled parts and a package box for various kinds of electric equipment, an appliance or the like, particularly applicable to a paper-made container (refill) or the like for carrying and filling consumables in a binding system that is provided with a cartridge into which a plurality of the consumables each having a long shape are loaded in a stacked manner.

The invention claimed is:

1. A container having six container-constituting surfaces, first and second constituting surfaces of the six container-constituting surfaces standing facing each other across an opening of a predetermined size formed at a third container-constituting surface, wherein the container is provided with at least a first folding surface that makes a mountain fold on the first constituting surface, the first folding surface having a width extending from the mountain fold and beyond the opening, and a second folding surface that makes a mountain fold on the first folding surface to engage the second constituting surface, wherein the first constituting surface defines a pair of first vertical slits of which a respective one is located on in each of a right position and a left position on the first constituting surface, and wherein the first folding surface extends from a portion of the first constituting surface between the ones of the pair of first vertical slits, and wherein when opening the container, the second folding surface disengages the second constituting surface and the first folding surface is folded back to a position so that it becomes the same wall surface as that of the first constituting surface, and the portion of the first constituting surface between the first vertical slits is bent.

2. The container according to claim 1 wherein the second constituting surface is provided with an engaged portion at its predetermined position and the second folding surface is provided with an engaging portion at its predetermined position;

when closing the opening, the engaging portion of the second folding surface engages the engaged portion of the second constituting surface; and when opening the container, the engaging portion of the second folding surface disengages the engaged portion of the second constituting surface and a part of the second folding surface is then cut off.

3. The container according to claim 1 wherein a configuration of cuts is formed on a predetermined position of the second folding surface, the cuts being away from the engaging portion by a predetermined distance; and a posture of the second folding surface is kept at a position that is nearly perpendicular to the first folding surface and a part of the second folding surface, the part being a side of the engaging portion, is cut off through the configuration of cuts with the posture of the second folding surface being kept.

4. The container according to claim 1 wherein the second constituting surface defines a pair of second vertical slits of which a respective one is located in each of a right position and a left position on the second constituting surface, and wherein a portion of the second constituting surface is between the ones of the pair of second vertical slits, and when opening the container, any one of the portion of the first constituting surface between the first vertical slits and the portion of the second constituting surface between the second vertical slits is bent.

5. The container according to claim 4 wherein the second constituting surface is provided with an engaged portion at its predetermined position and the second folding surface is provided with an engaging portion at its predetermined position;

when closing the opening, the engaging portion of the second folding surface engages the engaged portion of the second constituting surface; and when opening the container, the engaging portion of the second folding surface disengages the engaged portion of the second constituting surface and a part of the second folding surface is then cut off.

6. The container according to claim 4 wherein a configuration of cuts is formed on a predetermined position of the second folding surface, the cuts being away from the engaging portion by a predetermined distance; and a posture of the second folding surface is kept at a position that is nearly perpendicular to the first folding surface and a part of the second folding surface, the part being a side of the engaging portion, is cut off through the configuration of cuts with the posture of the second folding surface being kept.

* * * * *